US011891266B2

(12) United States Patent
Sakai

(10) Patent No.: US 11,891,266 B2
(45) Date of Patent: Feb. 6, 2024

(54) MEDIUM CONVEYING APPARATUS TO DETERMINE WHETHER MULTI-FEED HAS OCCURRED BASED ON WHETHER OUTER SHAPE OF OBJECT AREA IN INPUT IMAGE IS RECTANGULAR

(71) Applicant: PFU LIMITED, Kahoku (JP)

(72) Inventor: Masaaki Sakai, Kahoku (JP)

(73) Assignee: PFU LIMITED, Kahoku (JP)

( * ) Notice: Subject to any disclaimer, the term of this patent is extended or adjusted under 35 U.S.C. 154(b) by 53 days.

(21) Appl. No.: 17/578,117

(22) Filed: Jan. 18, 2022

(65) Prior Publication Data

US 2022/0258997 A1 Aug. 18, 2022

(30) Foreign Application Priority Data

Feb. 18, 2021 (JP) ..... 2021-024516

(51) Int. Cl.
*B65H 7/12* (2006.01)
*B65H 7/18* (2006.01)

(52) U.S. Cl.
CPC ..... *B65H 7/125* (2013.01); *B65H 7/18* (2013.01); *B65H 2511/13* (2013.01); *B65H 2511/524* (2013.01); *B65H 2553/30* (2013.01)

(58) Field of Classification Search
CPC . B65H 7/02; B65H 7/12; B65H 7/125; B65H 7/18; B65H 2511/10; B65H 2511/13; B65H 2511/524; B65H 2553/30
See application file for complete search history.

(56) References Cited

U.S. PATENT DOCUMENTS

| | | | | |
|---|---|---|---|---|
| 11,053,090 | B1 * | 7/2021 | Noviello | H04N 1/00039 |
| 2005/0228535 | A1 | 10/2005 | Simonis et al. | |
| 2011/0278791 | A1 * | 11/2011 | Fujii | B65H 7/125 271/265.04 |
| 2012/0025458 | A1 | 2/2012 | Simonis et al. | |
| 2014/0062008 | A1 * | 3/2014 | Hongo | B65H 7/02 271/258.01 |

FOREIGN PATENT DOCUMENTS

| | | |
|---|---|---|
| JP | 7-291485 A | 11/1995 |
| JP | 2011-241009 A | 12/2011 |

* cited by examiner

*Primary Examiner* — Prasad V Gokhale
(74) *Attorney, Agent, or Firm* — LEWIS ROCA ROTHGERBER CHRISTIE LLP

(57) ABSTRACT

A medium conveying apparatus includes a conveying roller to convey a rectangular medium, and a processor to generate an input image acquired by imaging the conveyed medium, detect an overlap of the conveyed medium, detect an object area from the input image, determine whether an outer shape of the object area is rectangular, determine whether a multi-feed of the medium has occurred based on whether the overlap of the medium has been detected and whether the outer shape of the object area is rectangular, and execute an abnormality processing when it is determined that the multi-feed of the medium has occurred.

12 Claims, 13 Drawing Sheets

MEDIUM CONVEYING APPARATUS TO DETERMINE WHETHER MULTI-FEED HAS OCCURRED BASED ON WHETHER OUTER SHAPE OF OBJECT AREA IN INPUT IMAGE IS RECTANGULAR

CROSS-REFERENCE TO RELATED APPLICATIONS

This application is based upon and claims the benefit of priority of prior Japanese Patent Application No. 2021-024516, filed on Feb. 18, 2021, the entire contents of which are incorporated herein by reference.

TECHNICAL FIELD

Embodiments discussed in the present specification relate to medium conveyance.

BACKGROUND

In general, a medium conveying apparatus such as a scanner has a function of detecting whether or not a multi-feed, that is, a plurality of media being conveyed in an overlapping manner has occurred, and automatically stopping the conveyance of the medium when the multi-feed has occurred. However, even when a medium to which a photograph is adhered, such as a resume, is transported, the medium conveying apparatus may determine that the multi-feed has occurred, and stop the conveyance. Therefore, when a user uses the medium conveying apparatus to scan the medium to which the photograph is adhered, the user needs to set the detection function of the multi-feed to OFF before the conveyance of the medium, thereby the convenience of the user is impaired.

A multi-feed processing apparatus which detects whether a shape of an outer periphery of a paper is changed on a boundary of an overlap detection portion of a medium based on vertical and horizontal sides of the overlap detection portion detected by an ultrasonic sensor and a shape of an entire paper acquired from a paper sensor, image information, etc., is disclosed (Japanese Unexamined Patent Publication (Kokai) No. 2011-241009). The multi-feed processing apparatus determines that the multi-feed has occurred when the shape of the outer periphery of the paper is changed on the boundary of the overlap detection portion.

A method of receiving a processed object and detecting a multi-feed of the object is disclosed (U.S. Patent Application Publication No. 2005/0228535). In this method, it is determined whether or not an overlap position of the multi-feed of the object is within an allowable range, and the processing of the object is continued when the position is within a predetermined overlap criterion, and the processing of the object is aborted when the position is not within the predetermined overlap criterion.

SUMMARY

According to some embodiments, a medium conveying apparatus includes a conveying roller to convey a rectangular medium, and a processor to generate an input image acquired by imaging the conveyed medium, detect an overlap of the conveyed medium, detect an object area from the input image, determine whether an outer shape of the object area is rectangular, determine whether a multi-feed of the medium has occurred based on whether the overlap of the medium has been detected and whether the outer shape of the object area is rectangular, and execute an abnormality processing when it is determined that the multi-feed of the medium has occurred.

According to some embodiments, a method for determining a multi-feed of a medium, includes, conveying a rectangular medium, by a conveying roller, generating an input image acquired by imaging the conveyed medium, detecting an overlap of the conveyed medium, detecting an object area from the input image, determining whether an outer shape of the object area is rectangular, determining whether a multi-feed of the medium has occurred based on whether the overlap of the medium has been detected and whether the outer shape of the object area is rectangular, and executing an abnormality processing when it is determined that the multi-feed of the medium has occurred.

According to some embodiments, a computer-readable, non-transitory medium stores a computer program. The computer program causes a medium conveying apparatus including a conveying roller to convey a rectangular medium, to execute a process including generating an input image acquired by imaging the conveyed medium, detecting an overlap of the conveyed medium, detecting an object area from the input image, determining whether an outer shape of the object area is rectangular, determining whether a multi-feed of the medium has occurred based on whether the overlap of the medium has been detected and whether the outer shape of the object area is rectangular, and executing an abnormality processing when it is determined that the multi-feed of the medium has occurred.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method for determining a multi-feed of a medium, and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
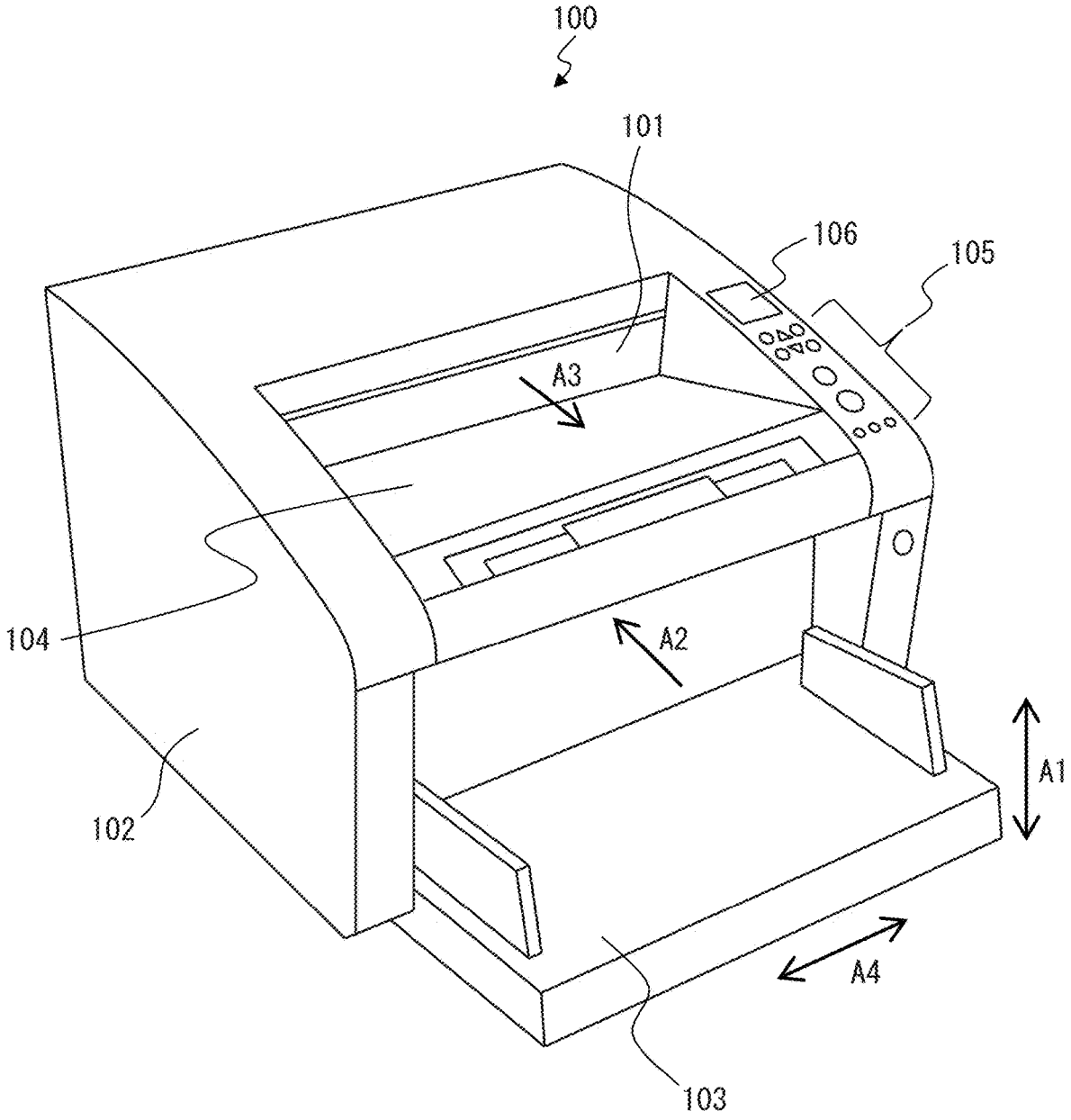
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. The medium is a paper, a thick paper, a card, etc. The medium includes a rectangular medium. The medium also includes a medium on which adhered object, such as a label (a seal) or a small size paper piece (a photograph, a cutout, a postage stamp, a revenue stamp, etc.), is adhered. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The media conveying apparatus 100 includes a first housing 101, a second housing 102, a medium tray 103, an ejection tray 104, an operation device 105 and a display device 106, etc.

The first housing 101 is located on an upper side of the medium conveying apparatus 100 and is engaged with the second housing 102 by hinges so as to be opened and closed at a time of medium jam, during cleaning the inside of the medium conveying apparatus 100, etc.

The medium tray 103 is engaged with the second housing 102 in such a way as to be able to place a medium to be conveyed. The medium tray 103 is provided on a side surface of the second housing 102 on a medium supply side to be movable in a substantially vertical direction (height direction) A1 by a motor (not shown). The medium tray 103 is located at a position of a lower end to easily place a medium on the medium tray 103 when the medium is not conveyed, and lifts to a position at which the medium placed on the uppermost side is in contact with a pick roller to be described later when the medium is conveyed. The ejection tray 104 is formed on the first housing 101 capable of holding the ejected medium, to load the ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

In FIG. 1, an arrow A2 indicates a medium conveying direction, an arrow A3 indicates a medium ejecting direction, and an arrow A4 indicates a width direction perpendicular to the medium conveying direction. Hereinafter, upstream refers to upstream of the medium conveying direction A2 or the medium ejecting direction A3, downstream refers to downstream of the medium conveying direction A2 or the medium ejecting direction A3.

Figure 2:
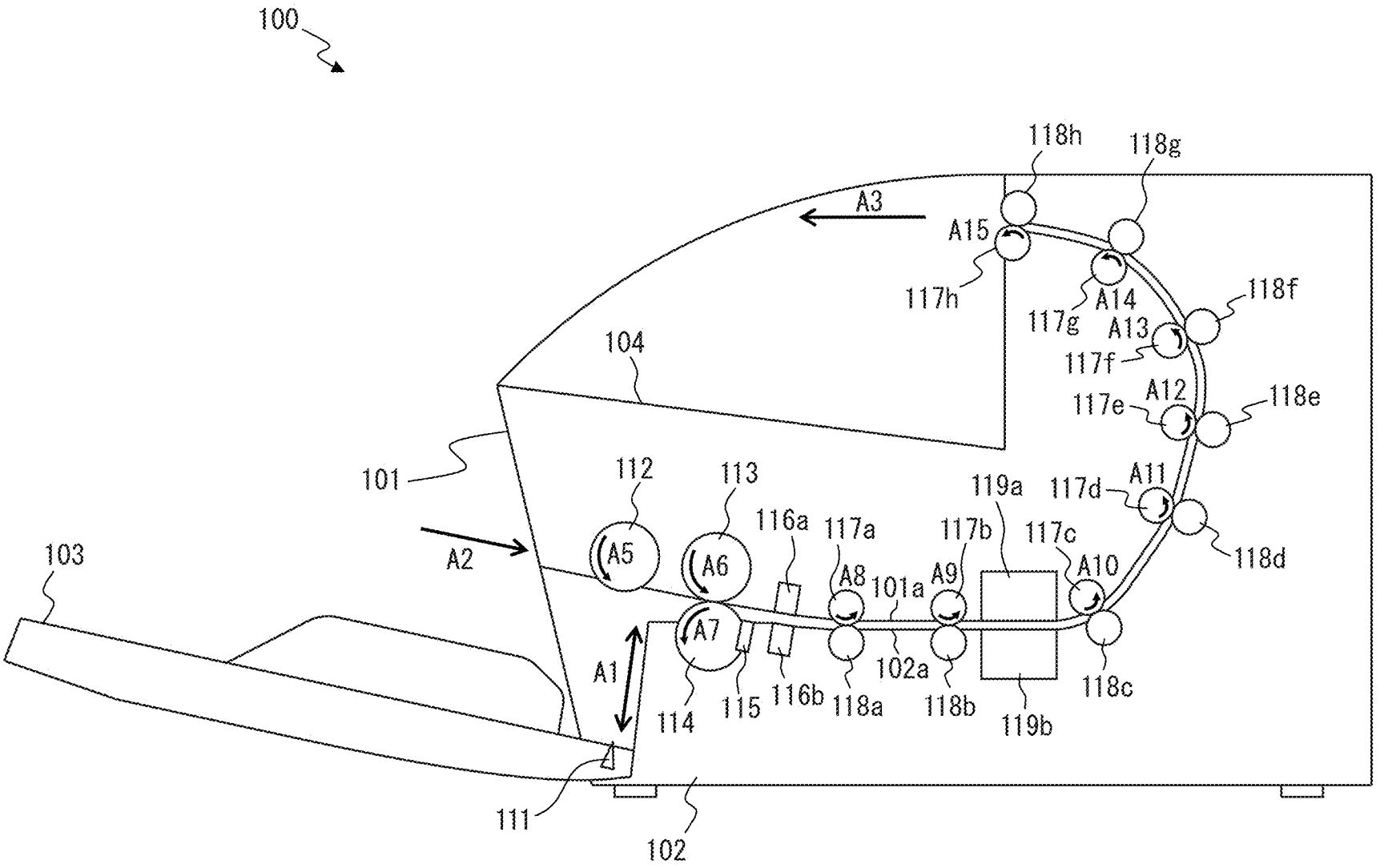
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a first medium sensor 111, a pick roller 112, a feed roller 113, a brake roller 114, a second medium sensor 115, an ultrasonic transmitter 116*a*, an ultrasonic receiver 116*b*, first to eighth conveyance rollers 117*a* to 117*h*, first to eighth driven rollers 118*a* to 118*h*, a first imaging device 119*a* and a second imaging device 119*b*, etc.

The pick roller 112, the feed roller 113, the brake roller 114, the first to eighth conveyance rollers 117*a* to 117*h*, and the first to eighth driven rollers 118*a* to 118*h* are examples of a conveying roller to convey the medium. The number of each of the pick roller 112, the feed roller 113, the brake roller 114, the first to eighth conveyance rollers 117*a* to 117*h*, and/or the first to eighth driven rollers 118*a* to 118*h* is not limited to one, and may be plural. In that case, the plurality of pick rollers 112, the feed rollers 113, the brake rollers 114, the first to eighth conveyance rollers 117*a* to 117*h* and/or the first to eighth driven rollers 118*a* to 118*h* are spaced and located along in the width direction A4, respectively. Hereinafter, the first imaging device 119*a* and the second imaging device 119*b* may be collectively referred to as imaging devices 119.

The surface of the first housing 101 facing the second housing 102 forms a first guide 101*a* of the medium conveyance path, and the surface of the second housing 102 facing the first housing 101 forms a second guide 102*a* of the medium conveyance path.

The first medium sensor 111 is located on the medium tray 103, i.e., on the upstream side of the feed roller 113 and the brake roller 114, to detect a placing state of the medium in the medium tray 103. The first medium sensor 111 determines whether or not the medium is placed on the medium tray 103, by a contact detection sensor to pass a predetermined current when a medium is in contact or a medium is not in contact. The first medium sensor 111 generates and outputs a first medium signal changing the signal value between a state in which a medium is placed on the medium tray 103 and a state in which a medium is not placed. The first medium sensor 111 is not limited to the contact detection sensor, and any other sensor, such as a light detection sensor, capable of detecting the presence or absence of the medium may be used as the first sensor 111.

The pick roller 112 is provided in the first housing 101, and comes into contact with the medium placed on the medium tray 103 lifted to a height substantially equal to that of the medium conveyance path to feed the medium to the downstream side.

The feed roller 113 is located in the first housing 101, and on the downstream side of the pick roller 112, to feed the medium placed on the medium tray 103 and fed by the pick roller 112 toward the further downstream side. The brake roller 114 is located in the second housing 102 and is located to face the feed roller 113. The feed roller 113 and the brake roller 114 perform a medium separation operation to separate the media and feed them one by one. The feed roller 113 is located on the upper side with respect to the brake roller 114, the medium conveying apparatus 100 feeds the medium by a so-called top-first type.

The second medium sensor 115 is located on the downstream side of the feed roller 113 and the brake roller 114 and on the upstream side of the ultrasonic transmitter 116*a* and the ultrasonic receiver 116*b*. The second medium sensor 115 detects whether or not the medium exists at the second medium sensor 115. The second medium sensor 115 includes a light emitter and a light receiver provided on one side with respect to the conveyance path of the medium, and a reflection member such as a mirror provided at a position facing the light emitter and the light receiver across the conveyance path. The light emitter emits light toward the conveyance path. On the other hand, the light receiver receives light projected by the light emitter and reflected by the reflection member, and generates and outputs a second medium signal being an electric signal based on intensity of the received light. Since the light emitted by the light emitter is shielded by the medium when the medium exists at the position of the second medium sensor 115, a signal value of the second medium signal is changed in a state in which the medium exists at the position of the second medium sensor 115 and a state in which a medium does not exist at the position. The light emitter and the light receiver may be provided at positions facing one another with the conveyance path in between, and the reflection member may be omitted.

The ultrasonic transmitter 116*a* and the ultrasonic receiver 116*b* are located on the downstream side of the feed roller 113 and the brake roller 114 and on the upstream side of the first to eighth conveyance rollers 117*a* to 117*h* and the first to eighth driven rollers 118*a* to 118*h*. The ultrasonic transmitter 116*a* and the ultrasonic receiver 116*b* are located close to the conveyance path of the medium in such a way as to face one another with the conveyance path in between. The ultrasonic transmitter 116*a* outputs an ultrasonic wave. On the other hand, the ultrasonic receiver 116*b* receives the ultrasonic wave transmitted by the ultrasonic transmitter 116*a* and passing through the medium, and generates and outputs an ultrasonic signal being an electric signal corresponding to the received ultrasonic wave. The ultrasonic signal indicates a transmission information of the ultrasonic wave transmitted through the medium at a plurality of positions in the medium conveyed by the conveying roller. The transmission information indicates the magnitude of the ultrasonic wave received by the ultrasonic receiver 116*b*. Hereinafter, the ultrasonic transmitter 116*a* and the ultrasonic receiver 116*b* may be collectively referred to as an ultrasonic sensor 116. The number of ultrasonic sensors 116 is not limited to one, and may be plural. In that case, a plurality of ultrasonic sensors 116 are spaced and located along in the width direction A4.

The first to eighth conveyance rollers 117*a* to 117*h* and the first to eighth driven rollers 118*a* to 118*h* are provided on the downstream side of the feed roller 113 and the brake roller 114, to convey the medium fed by the feed roller 113 and the brake roller 114 toward the downstream side. The first to eighth conveyance rollers 117*a* to 117*h* and the first to eighth driven rollers 118*a* to 118*h* are located to face each other with the medium conveyance path in between.

The first imaging device 119*a* is an example of an imaging device, and is provided on the downstream side of the first conveyance roller 117*a* and the first driven roller 118*a* in the medium conveying direction A2, i.e., on the downstream side of the ultrasonic sensor 116. The first imaging device 119*a* includes a line sensor based on a unity-magnification optical system type contact image sensor (CIS) including an imaging element based on a complementary metal oxide semiconductor (CMOS) linearly located in a main scanning direction. Further, the first imaging device 119*a* includes a lens for forming an image on the imaging element, and an A/D converter for amplifying and analog-digital (A/D) converting an electric signal output from the imaging element. The first imaging device 119*a* sequentially generates and outputs line images acquired by imaging a front surface of the conveyed medium. Specifically, a pixel count of a line image in a vertical direction (sub-scanning direction) is 1, and a pixel count in a horizontal direction (main scanning direction) is larger than 1.

Similarly, the second imaging device 119*b* is an example of an imaging device, and is provided on the downstream side of the first conveyance roller 117*a* and the first driven roller 118*a* in the medium conveying direction A2. The second imaging device 119*b* includes a line sensor based on a unity-magnification optical system type CIS including an imaging element based on a CMOS linearly located in a main scanning direction. Further, the second imaging device 119*b* includes a lens for forming an image on the image element, and an A/D converter for amplifying and analog-digital (A/D) converting an electric signal output from the imaging element. The second imaging device 119*b* sequentially generates and outputs line images acquired by imaging a back surface of the conveyed medium.

Only either of the first imaging device 119*a* and the second imaging device 119*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs may be used.

A medium placed on the medium tray 103 is conveyed in the medium conveying direction A2 between the first guide 101*a* and the second guide 102*a* by the pick roller 112 rotating in a medium feeding direction A5 and the feed roller 113 rotating in a medium feeding direction A6. On the other hand, when a plurality of media are placed on the medium tray 103, only a medium in contact with the feed roller 113, out of the media placed on the medium tray 103 is separated, by the brake roller 114 rotating in a direction A7 opposite to the medium feeding direction.

While being guided by the first guide 101*a* and the second guide 102*a*, the medium is fed to the imaging position of the imaging device 119 by the first to second conveyance rollers 117*a* to 117*b* rotating in directions of arrows A8 to A9, and is imaged by the imaging device 119. The medium is ejected on the ejection tray 104 by the third to eighth conveyance rollers 117*c* to 117*h* rotating in directions of arrows A10 to A15, respectively. The ejection tray 104 loads the medium ejected by the eighth conveyance roller 117*h*.

Figure 3:
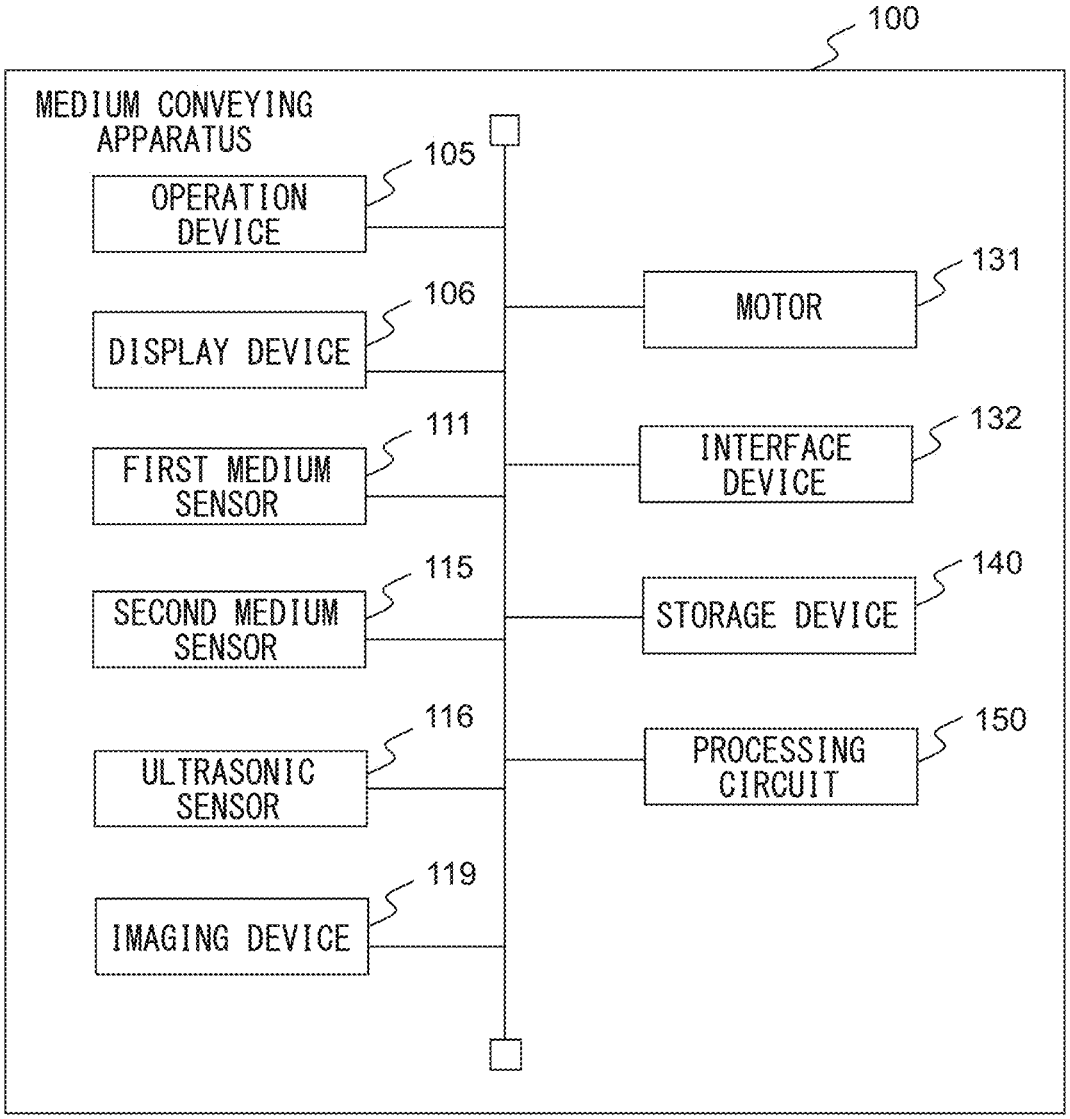
FIG. 3 is a block diagram illustrating a schematic configuration of the medium conveying apparatus 100.

FIG. 3 is a block diagram illustrating a schematic configuration of the medium conveying apparatus 100.

The medium conveying apparatus 100 further includes a motor 131, an interface device 132, a storage device 140, and a processing circuit 150, etc., in addition to the configuration described above.

The motor 131 includes one or more motors and rotates the pick roller 112, the feed roller 113, the brake roller 114, and the first to eighth conveyance rollers 117*a* to 117*h* by a control signal from the processing circuit 150 to feed and convey the medium. The first to eighth driven rollers 118*a* to 118*h* may be provided to rotate by the driving force from the motor rather than to be driven to rotate according to the rotation of each conveyance roller.

The interface device 132 includes, for example, an interface circuit conforming to a serial bus such as universal serial bus (USB), is electrically connected to an unillustrated information processing device (for example, a personal computer or a mobile information terminal), and transmits and receives an input image and various types of information. Further, a communication device including an antenna transmitting and receiving wireless signals, and a wireless communication interface circuit for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The processing circuit 150 operates in accordance with a program previously stored in the storage device 140. The processing circuit 150 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operation device 105, the display device 106, the first medium sensor 111, the second medium sensor 115, the ultrasonic sensor 116, the imaging device 119, the motor 131, the interface device 132 and the storage device 140, etc., and controls each of these units. The processing circuit 150 controls the motor 131 to convey the medium, controls the imaging device 119 to acquire an input image, and transmits the acquired input image to the information processing apparatus via the interface device 132. Further, the processing circuit 150 determines whether or not an overlap of the medium is detected based on the ultrasonic signal received from the ultrasonic sensor 116, and determines whether or not an outer shape of an object area in an image is rectangular based on the line image received from the imaging device 119. The processing circuit 150 determines whether or not a multi-feed of the medium has occurred based on whether or not the overlap of the medium has been detected and whether or not the outer shape of the object area is rectangular.

Figure 4:
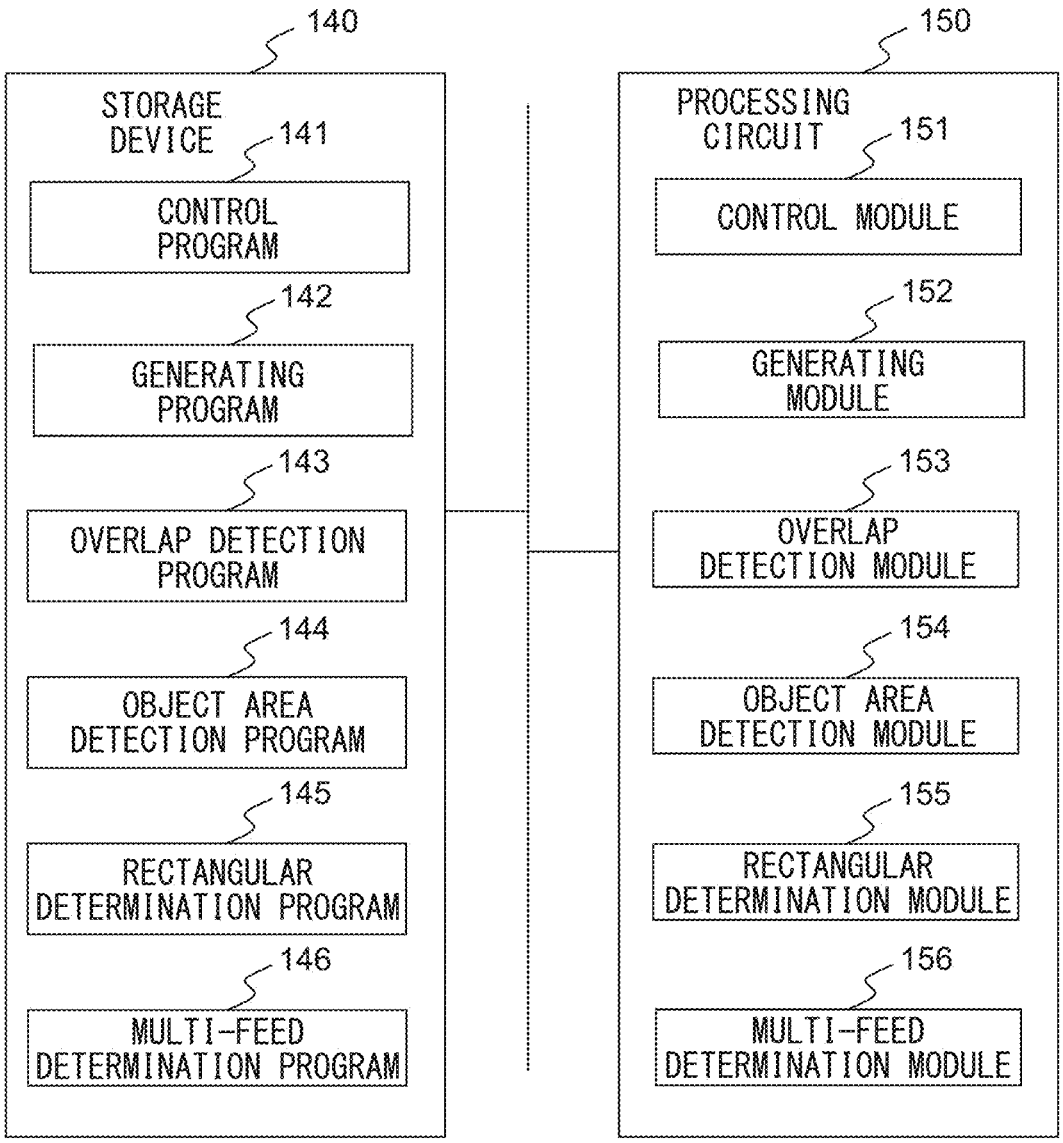
FIG. 4 is a diagram illustrating schematic configurations of a storage device 140 and a processing circuit 150.

FIG. 4 is a diagram illustrating schematic configurations of a storage device 140 and a processing circuit 150.

As illustrated in FIG. 4, each program such as a control program 141, a generating program 142, an overlap detection program 143, an object area detection program 144, a rectangular determination program 145, and a multi-feed determination program 146 is stored in the storage device 140. Each of these programs is a functional module implemented by software operating on a processor. The processing circuit 150 reads each program stored in the storage device 140 and operates according to the read programs, to function as a control module 151, a generating module 152, an overlap detection module 153, an object area detection module 154, a rectangular determination module 155, and a multi-feed determination module 156.

Figure 5:
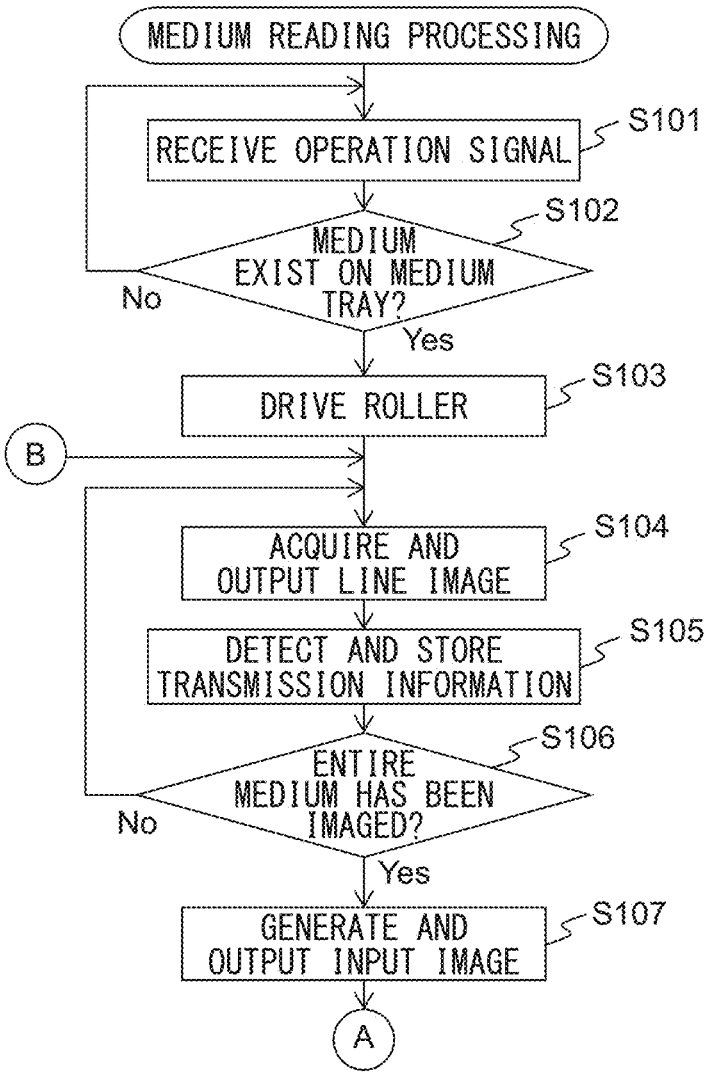
FIG. 5 is a flowchart illustrating an operation example of a medium reading processing.
Figure 6:
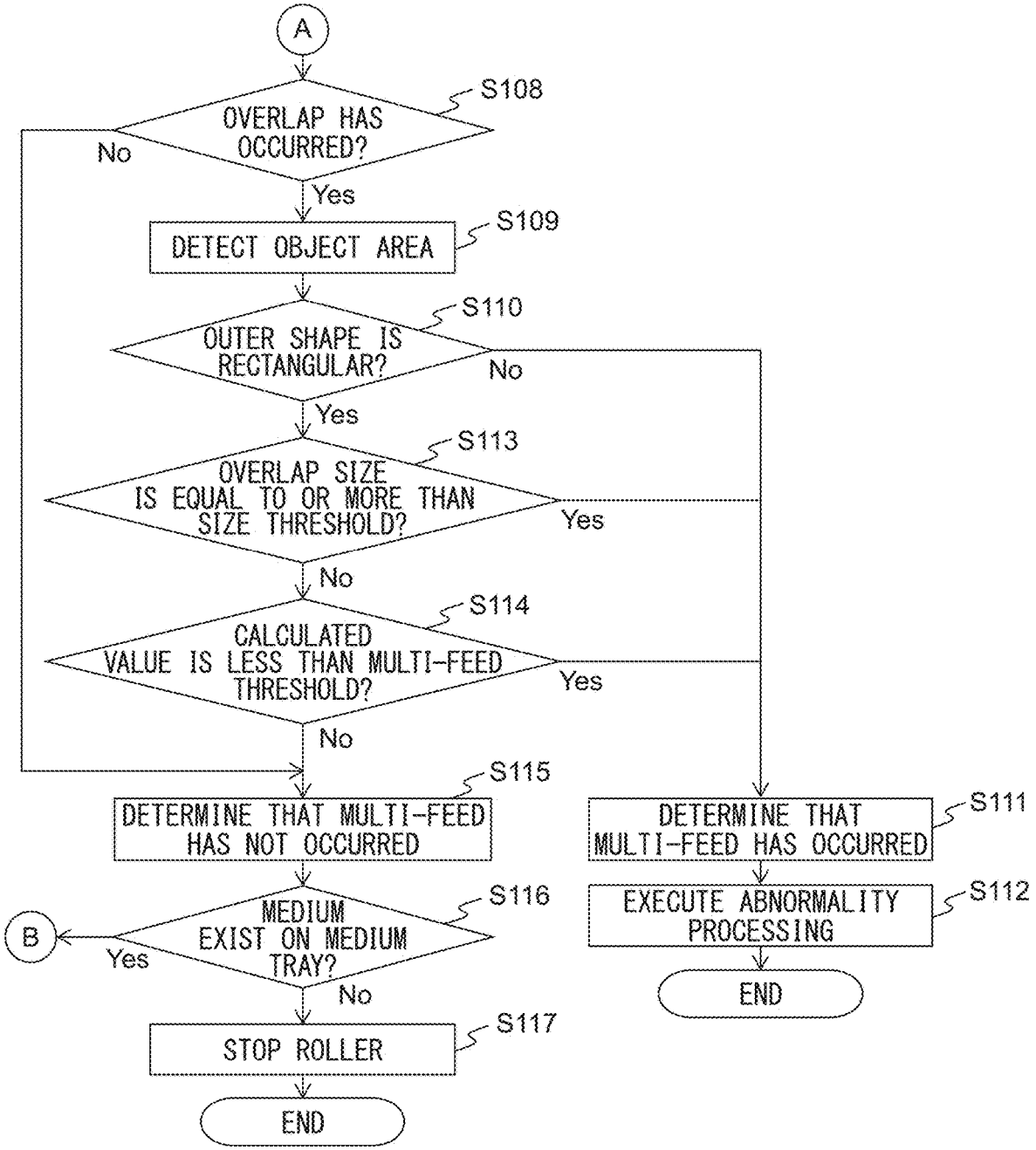
FIG. 6 is a flowchart illustrating an operation example of the medium reading processing.

FIGS. 5 and 6 are flowcharts illustrating an operation example of a medium reading processing.

Referring to the flowchart illustrated in FIGS. 5 and 6, the operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140.

First, the control module 151 stands by until an instruction to read a medium is input by the user by use of the operation device 105 or the information processing device, and an operation signal instructing to read the medium is received from the operation device 105 or the interface device 132 (step S101).

Next, the control module 151 acquires the first medium signal from the first medium sensor 111, and determines whether or not the medium is placed on the medium tray 103 based on the acquired first medium signal (step S102). When a medium is not placed on the medium tray 103, the control module 151 returns the processing to step S101 and stands by until newly receiving an operation signal from the operation device 105 or the interface device 132.

On the other hand, when the medium is placed on the medium tray 103, the control module 151 drives the motor for moving the medium tray 103 to move the medium tray 103 to a position capable of feeding the medium. The control module 151 drives the motor 131 to rotate the pick roller 112, the feed roller 113, the brake roller 114, and the first to eighth conveyance rollers 117*a* to 117*h* to feed and convey the medium placed on the mounting table 103 (step S103).

Next, the generating module 152 causes the imaging device 119 to image the conveyed medium, acquires a line image, and stores it in the storage device 140 (step S104). The generating module 152 may determine whether or not the front end of the medium has passed through the position of the second medium sensor 115 based on the second medium signal received from the second medium sensor 115, and cause the imaging device 119 to start imaging when the front end of the medium passes through the position of the second medium sensor 115. The generating module 152 acquires the second medium signal periodically from the second medium sensor 115, and determines that the front end of the medium passed through the position of the second medium sensor 115 when a signal value of the second medium signal changes from a value indicating that a medium does not exist to a value indicating that a medium exists.

Next, the overlap detection module 153 receives the ultrasonic signal from the ultrasonic sensor 116. The overlap detection module 153 detects the transmission information indicated in the received ultrasonic signal as the transmission information of the ultrasonic wave transmitted through the medium conveyed by the conveying roller, and stores the transmission information in the storage device 140 in association with the present time (step S105).

Next, the generating module 152 determines whether or not the entire medium has been imaged (step S106). The generating module 152, for example, determines whether or not the rear end of the medium has passed through the position of the second medium sensor 115 based on the second medium signal received from the second medium sensor 115. The generating module 152 acquires the second medium signal periodically from the second medium sensor 115, and determines that the rear end of the medium passed through the position of the second medium sensor 115 when a signal value of the second medium signal changes from a value indicating that a medium exists to a value indicating that a medium does not exist. The generating module 152 determines that the rear end of the medium passes through the imaging position of the imaging device 119, and the entire medium has been imaged when a predetermined time has elapsed after the rear end of the medium passed through the position of the second medium sensor 115. The generating module 152 may determine the entire conveyed medium has been imaged when a predetermined time has elapsed after the start of feeding of the medium. When the entire conveyed medium has not been imaged, the generating module 152 returns the process to step S104 and repeats the processes of steps S104 to S106.

On the other hand, when the entire conveyed medium has been imaged, the generating module 152 generates an input image acquired by imaging the medium conveyed by the conveying unit, by synthesizing the line images acquired so far. The generating module 152 outputs the generated input image by transmitting it to the information processing apparatus via the interface device 132 (step S107).

Next, the overlap detection module 153 determines whether or not the overlap of the medium conveyed by the conveying roller has occurred, based on the transmission information stored in the storage device 140 in step S105 (step S108). The overlap detection module 153 compares the calculated value based on the transmission information stored in the storage device 140 with the overlap threshold to determine whether or not the overlap of the media has occurred. The overlap threshold is set to a value between the transmission information detected when one medium is conveyed and the transmission information detected when the multi-feed of the medium is occurring. The calculation module 153 calculates a statistical value (an average value, a median value, a maximum value or a minimum value) of the transmission information detected within a predetermined period before and after each transmission information is detected, as the calculated value. The calculation module 156 may use each transmission information itself, as the calculated value. The overlap detection module 153 determines that the overlap of the medium has occurred when any of the calculated values is less than the overlap threshold, and the overlap detection module 153 determines that the overlap of the medium has not occurred when all the calculated values are equal to or more than the overlap threshold. Thus, the overlap detection module 153 detects the overlap of the medium conveyed by the conveying unit based on the transmission information of the ultrasonic wave transmitted through the conveyed medium. When it is determined that the overlap of the medium has not occurred, the overlap detection module 153 proceeds the process to step S115.

Figure 7A:
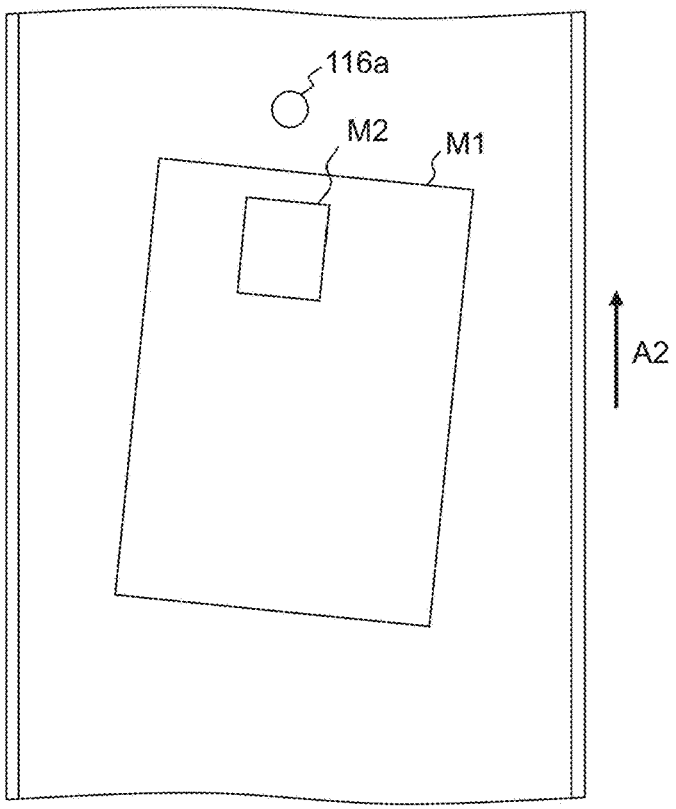
FIG. 7A is a schematic diagram for illustrating an overlap of a medium.
Figure 7B:
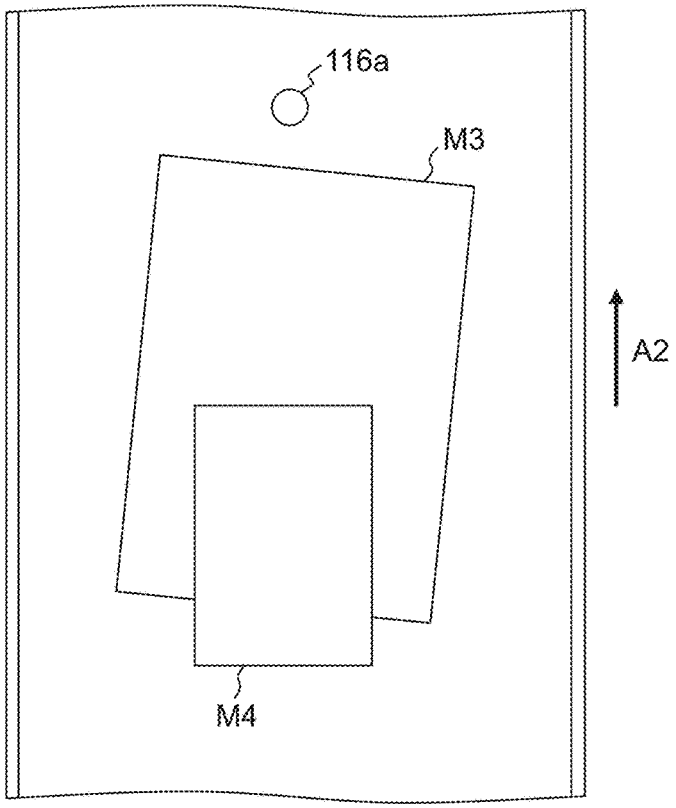
FIG. 7B is a schematic diagram for illustrating the overlap of the medium.

FIGS. 7A and 7B are schematic diagrams for illustrating the overlap of the medium.

FIGS. 7A and 7B are schematic diagrams of a state in which a medium is fed as viewed from the bottom. FIG. 7A shows a state in which a medium M1, such as a PPC (Plain Paper Copier) paper, to which an adhered object M2, such as a revenue stamp, is adhered, is conveyed. FIG. 7B shows a state in which a medium M3 such as a PPC paper and a medium M4 such as a PPC paper are conveyed in an overlapped manner. After the front ends of the media are well separated by the feed roller 113 and the brake roller 114, a frictional force between a fed medium and a medium in contact with the fed medium may become larger than a separation force by the feed roller 113 and the brake roller 114, and thereby, the multi-feed may occur. In that case, as shown in FIG. 7B, the medium M4 in contact with the medium M3 at the rear end side of the medium M3 may be conveyed in an overlapped manner without the occurrence of the multi-feed at the front end side of the fed medium M3.

Figure 8A:
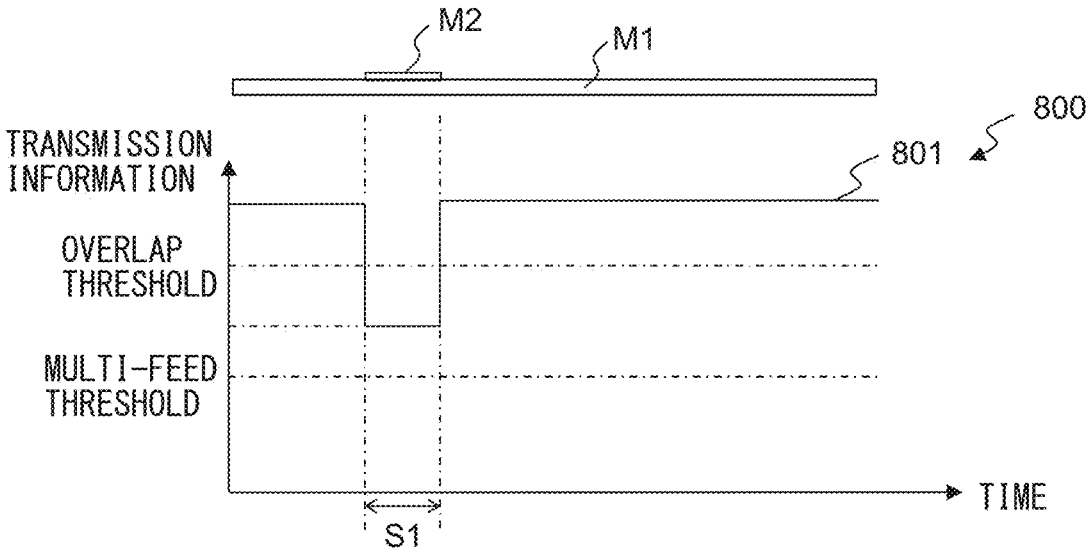
FIG. 8A is a graph showing characteristics of transmission information.
Figure 8B:
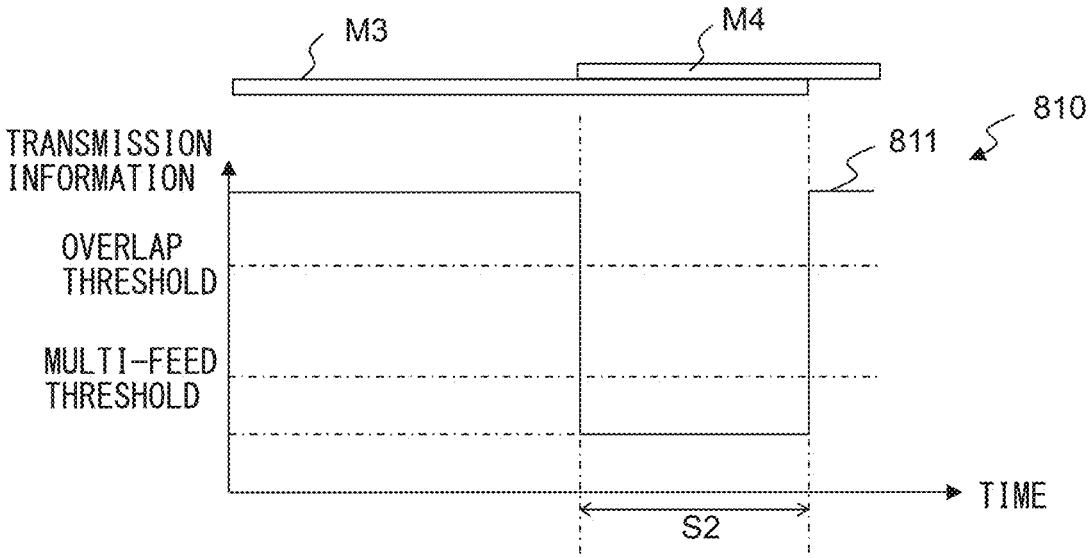
FIG. 8B is a graph showing the characteristics of the transmission information.

The FIGS. 8A and 8B are graphs 800 and 810 illustrating characteristics of the transmission information (the magnitude of the ultrasonic wave).

The horizontal axes of the graph 800 and the graph 810 indicate time, the vertical axes indicate the value of the transmission information. In the graph 800, the solid line 801 indicates the characteristics of the transmission information when the medium M1 and the adhered object M2 shown in FIG. 7A are conveyed. In the area in which the adhered object M2 is adhered in the medium M1, the amount of the attenuation of the ultrasonic wave is increased, the value of the transmission information is decreased, and is less than the overlap threshold. On the other hand, in the graph 810, the solid line 811 indicates the characteristics of the transmission information when the medium M3 and the medium M4 shown in FIG. 7B are conveyed. In the area in which the medium M3 and the medium M4 overlap, the amount of the attenuation of the ultrasonic wave is increased, the value of the transmission information is decreased, and is less than the overlap threshold. Therefore, the overlap detection module 153 detects the overlap of the medium when the medium to which the adhered object is adhered is conveyed, or when a plurality of media are conveyed in an overlapped manner.

When it is determined that the overlap of the medium has occurred, the object area detection module 154 detects an object area including an object (the conveyed medium) from the input image generated in step S107 (step S109).

The object area detection module 154 calculates an absolute value (hereinafter, referred to as an adjacent difference value) of the difference between the gradation values of both adjacent pixels in the vertical direction of each pixel in each vertical line, in order from the upper side, for each vertical line extending in the vertical direction (the sub-scanning direction) in the input image. The object area detection module 154 detects a pixel whose adjacent difference value exceeds a gradation threshold in each vertical line as the edge pixel. The gradation value is a luminance value or a color value (R value, G value or B value). For example, the gradation threshold may be set to a difference in brightness value (for example, 20) according to which a person may determine a difference in brightness on an image by visual observation. The object area detection module 154 detects the edge pixel that is initially detected in each vertical line, i.e., the pixel located at the uppermost side, as the upper edge pixel, and detects the edge pixel that is finally detected in each vertical line, i.e., the pixel located at the lowermost side, as the lower edge pixel.

Similarly, the object area detection module 154 calculates the adjacent difference values sequentially from the left side for each horizontal line extending in the horizontal direction (the main scanning direction) in the input image, and detects a pixel whose adjacent difference value exceeds the gradation threshold in each horizontal line as the edge pixel. The object area detection module 154 detects the edge pixel that is initially detected in each horizontal line, i.e., the pixel located at the leftmost side, as the left edge pixel, and detects the edge pixel that is finally detected in each horizontal line, i.e., the pixel located on the rightmost side, as the right edge pixel.

The object area detection module 154 may calculate the absolute value of the difference between the gradation values of the two pixels separated each other by a predetermined distance in the horizontal or vertical direction in the input image as the adjacent difference value. Further, the object area detection module 154 may detect the edge pixel by comparing the gradation value of each pixel in the input image with the threshold. For example, the object area detection module 154 detects a specific pixel as the edge pixel when the gradation value of the specific pixel is less than the threshold value and the gradation value of the pixel adjacent to the specific pixel in the vertical direction or the pixel separated by a predetermined distance in the horizontal direction is equal to or more than the threshold value.

Next, the object area detection module 154 detects a straight line from each edge pixel using the least squares method. The object area detection module 154 detects a straight line passing through each upper edge pixel, a straight line passing through each lower edge pixel, a straight line passing through each left edge pixel, and a straight line passing through each right edge pixel, as an upper end straight line, a lower end straight line, a left end straight line, and a right end straight line, respectively. The object area detection module 154 may detect a straight line from each edge pixel using the Huff transform. The object area detection module 154 detects an area surrounded by each detected straight line as the object area.

Figure 9A:
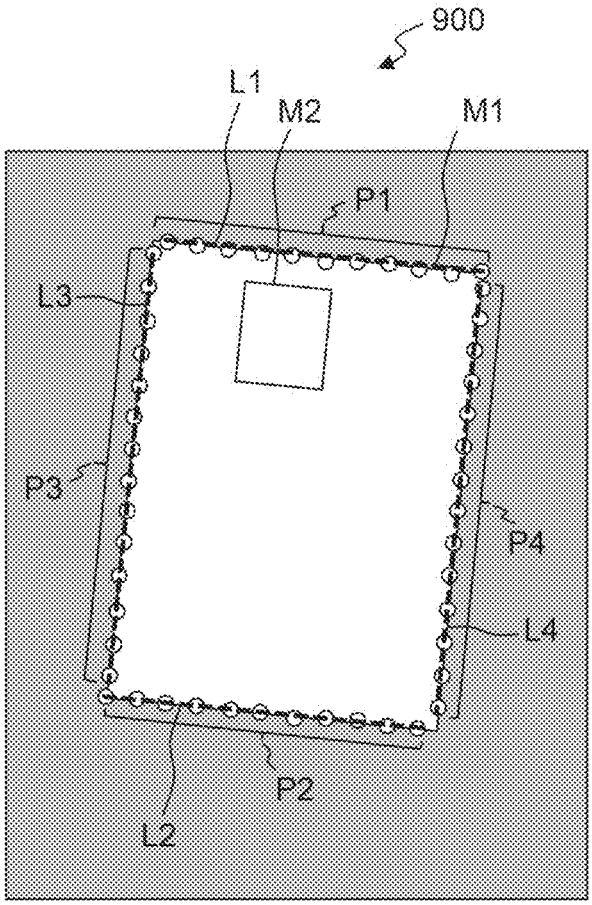
FIG. 9A is a schematic diagram illustrating an example of an input image.
Figure 9B:
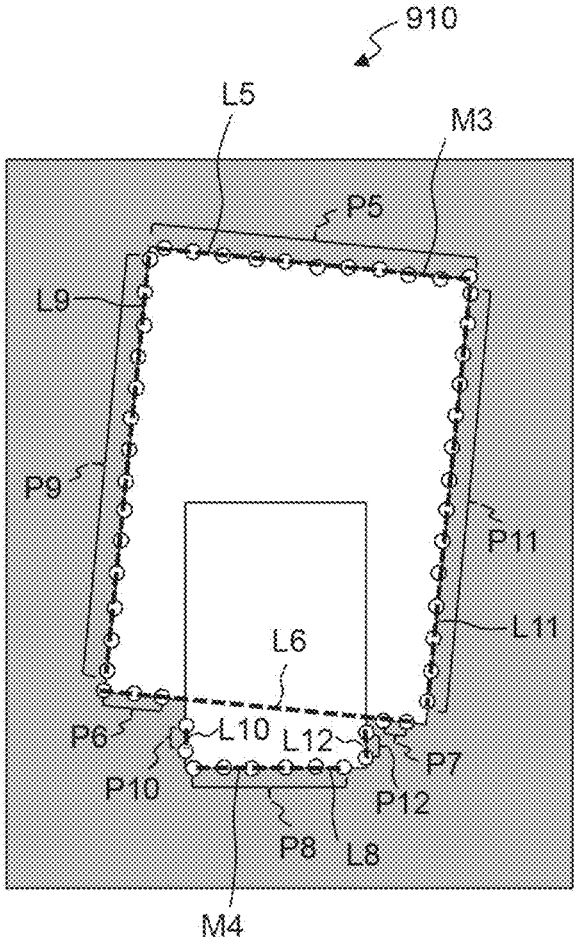
FIG. 9 B is a schematic diagram illustrating an example of the input image.

FIGS. 9A and 9B are schematic diagrams illustrating an example of the input image.

FIG. 9A shows an input image 900 generated when the medium M1 and the adhered object M2 shown in FIG. 7A are conveyed. Since the adhered object M2 is located inside the medium M1, an outer edge of the entire object is constituted only by the outer edge of the medium M1, in the input image 900. Therefore, a pixel group P1 corresponding to the upper end of the medium M1, a pixel group P2 corresponding to the lower end of the medium M1, a pixel group P3 corresponding to the left end of the medium M1, and a pixel group P4 corresponding to the right end are of the medium M1 are detected, respectively, as the upper edge pixel, the lower edge pixel, the left edge pixel, and the right edge pixel. Then, a straight line L1 corresponding to the upper end of the medium M1, a straight line L2 corresponding to the lower end of the medium M1, a straight line L3 corresponding to the left end of the medium M1, and a straight line L4 corresponding to the right end of the medium M1 are detected, respectively, as the upper end straight line, the lower end straight line, the left end straight line, and the right end straight line.

FIG. 9B shows an input image 910 generated when the medium M3 and medium M4 shown in FIG. 7B are conveyed. Since the medium M4 is located to straddle the rear end of the medium M3, the outer edge of the entire object is constituted by the outer edge of the medium M3 and the outer edge of the medium M4, in the input image 910. Therefore, a pixel group P5 corresponding to the upper end of the medium M3 is detected as the upper edge pixel. Pixel groups P6 and P7 corresponding to the lower end of the medium M3, and a pixel group P8 corresponding to the lower end of the medium M4 are detected as the lower edge pixel. A pixel group P9 corresponding to the left end of the medium M3, and a pixel group P10 corresponding to the left end of the medium M4 are detected as the left edge pixel. A pixel group P11 corresponding to the right end of the medium M3, and a pixel group P12 corresponding to the right end of the medium M4 are detected as the right edge pixel. A straight line L5 corresponding to the upper end of the medium M3 is detected as the upper end straight line. A straight line L6 corresponding to the lower end of the medium M3, and a straight line L8 corresponding to the lower end of the medium M4 are detected as the lower end straight line. A straight line L9 corresponding to the left end of the medium M3, and a straight line L10 corresponding to the left end of the medium M4 are detected as the left end straight line. A straight line L11 corresponding to the right end of the medium M3, and a straight line L12 corresponding to the right end of the medium M4 are detected as a right end straight line.

Next, the rectangular determination module 155 determines whether or not an outer shape of the object area detected by the object area detection module 154 is rectangular (step S110). For example, the rectangular determination module 155 calculates an evaluation point indicating a degree of rectangular likelihood, and determines whether or not the outer shape of the object area is rectangular depending on whether or not the evaluation point is equal to or more than an evaluation threshold. The evaluation threshold is set to a value between the evaluation point calculated from the object area detected when one medium is conveyed and the evaluation point calculated from the object area detected when a plurality of media are conveyed in an overlapped manner to straddle the end thereof each other. The rectangular determination module 155 calculates the evaluation point based on the relationship of the detected plurality of straight lines.

For example, the rectangular determination module 155 calculates the evaluation point based on an angle formed by each straight line detected as the upper end straight line, the lower end straight line, the left end straight line and the right end straight line. The rectangular determination module 155 selects any one straight line of the detected upper end straight line, the lower end straight line, the left end straight line or the right end straight line, as a reference line. The rectangular determination module 155 increases the evaluation point as a statistical value (a minimum value, a maximum value, an average value or a median value) of each angle between the reference line and each straight line substantially parallel to the reference line is smaller, and decreases the evaluation point as the statistical value is larger. When the reference line is the upper end straight line, each straight line substantially parallel to the reference line is the other upper end straight line or the lower end straight line. Further, the rectangular determination module 155 increases the evaluation point as the statistical value of a difference between 90° and each angle between the reference line and each straight line substantially perpendicular to the reference line is smaller, and decreases the evaluation point as the statistical value is higher. When the reference line is the upper end straight line, each straight line substantially perpendicular to the reference line is the left end straight line or the right end straight line.

In the input image 900 shown in FIG. 9A, for example, when the upper end line L1 is selected as the reference line, the angle formed by the upper end line L1 and the lower end line L2 is close to 0°, the angle formed by the upper end line L1 and, the left end line L3 and the right end line L4 is close to 90°. Therefore, the evaluation point thereof is high. On the other hand, in the input image 910 shown in FIG. 9B, for example, when the upper end line L5 is selected as the reference line, although the angle formed by the upper end line L5 and the lower end line L6 is close to 0°, the angle formed by the upper end line L5 and the lower end line L8 is away from 0°. Further, the angle formed by the upper end line L5 and, the left end line L9 and the right end line L11 is close to 90°, the angle formed by the upper end line L5 and the left end line L10 and the right end line L12 is away from 90°. Therefore, the evaluation point thereof is low.

The rectangular determination module 155 may calculate the evaluation point based on the number of straight lines respectively detected as the upper end straight line, the lower end straight line, the left end straight line and the right end straight line. The rectangular determination module 155 increases the evaluation point as the number of straight lines respectively detected as the upper end straight line, the lower end straight line, the left end straight line and the right end straight line is closer to 1, and decreases the evaluation point as the number of lines is away from 1.

In the input image 900 shown in FIG. 9A, the number of straight lines respectively detected as the upper end line, the lower end line, the left end line and the right end line is one (a straight line L1, a straight line L2, a straight line L3 and a straight line L4). Therefore, the evaluation point is high. On the other hand, in the input image 910 shown in FIG. 9B, although the number of the straight line detected as the upper end straight line is one (a straight line L5), the number of the straight lines respectively detected as the lower end straight line, the left end straight line and the right end straight line is two (straight lines L6 and L8, straight lines L9 and L10, straight lines L11 and L12). Therefore, the evaluation point is low.

The rectangular determination module 155 may calculate the evaluation point based on lengths of the straight lines respectively detected as the upper end straight line, the lower end straight line, the left end straight line and the right end straight line. The rectangular determination module 155 calculates a distance between the edge pixels corresponding to both ends of each detected straight line, as the length of each straight line. The rectangular determination module 155 may calculate the maximum continuous number of edge pixels adjacent to each other among the edge pixels corresponding to each detected straight line, as the length of each straight line. Alternatively, the rectangular determination module 155 may calculate a density of the edge pixels (a ratio of the number of edge pixels to the total number of pixels) in each area of a predetermined range from each pixel located on each of the detected straight lines. The rectangular determination module 155 may calculate the maximum continuous number of pixels adjacent to each other among pixels whose density is equal to or more than a predetermined threshold, as the length of each straight line.

The rectangular determination module 155 selects a straight line of any one of the detected upper end straight line and lower end straight line, and any one of the straight line of the detected left end straight line and right end straight line, as the reference line. For example, the rectangular determination module 155 selects the longest straight line among each straight line, as the reference line. The rectangular determination module 155 may select the shortest straight line among each straight line, as the reference line. The rectangular determination module 155 increases the evaluation point as a statistical value (a minimum value, a maximum value, an average value or a median value) of a difference between a length of the selected reference line and each straight line facing the reference line is smaller, and decreases the evaluation point as the statistical value is larger. When the reference line is the upper end straight line, a straight line facing the reference line is the lower end straight line.

In the input image 900 shown in FIG. 9A, a length of the upper end straight line L1 and a length of the lower end straight line L2 are substantially equal, and a length of the left end straight line L3 and a length of the right end straight line L4 are substantially equal. Therefore, the evaluation point is high. On the other hand, in the input image 910 shown in FIG. 9B, for example, when the upper end straight line L5 is selected as the reference line, although a length of the upper end straight line L5 and a length of the lower end straight line L6 are substantially equal, a difference between the length of the upper end straight line L5 and a length of the lower end straight line L8 is large. Further, when the left end line L9 is selected as the reference line, although a length of the left end line L9 and a length of the right end line L11 are substantially equal, a difference between the length of the left end line L9 and a length of the right end line L12 is large. Therefore, the evaluation point is low.

In this way, the rectangular determination module 155 determines whether or not the outer shape of the object area is rectangular based on the angle formed by a plurality of straight lines included in the input image, the number of a plurality of straight lines, or the length of a plurality of straight lines. Thus, the rectangular determination module 155 can accurately determine whether or not the outer shape of the object area is rectangular.

The object area detection module 154 may detect the object area by another method, and the rectangular determination module 155 may determine whether or not the outer shape of the object area is rectangular by another method. For example, the object area detection module 154 performs a binarization processing using a binarization threshold for a gradation value of each pixel in the input image, to generate a binarized image in which pixels less than the binarization threshold are converted into effective pixels (black pixels) and pixels equal to or more than the binarization threshold are converted into ineffective pixels (white pixels). The binarization threshold is set to a predetermined value (e.g., 128) or an average value of gradation values of all pixels in the input image. The object area detection module 154 replaces pixels in an area surrounded by the effective pixels with effective pixels in the binarized image to detect the area as the object area.

On the other hand, the rectangular determination module 155, for example, determines whether or not the outer shape of the object area is rectangular, using a pattern matching technique. The rectangular determination module 155 calculates a degree of similarity between the object area in the binarized image and a plurality of rectangles in which lengths of a long side and a short side are changed in a plurality of ways. For example, a normalized cross-correlation value is used as the degree of similarity. When any of the calculated degree of similarity is equal to or more than a threshold, the rectangular determination module 155 determines that the outer shape of the object area is rectangular.

Further, the rectangular determination module 155 may determine whether or not the outer shape of the object area is rectangular by a discriminator previously learned to output whether or not a rectangle is included in an image input to the discriminator, using a machine learning technique. The discriminator is previously learned, for example, by deep learning, etc., using a plurality of correct images including a rectangle, and a plurality of incorrect images not including a rectangle, and is stored in advance in the storage device 140. The rectangular determination module 155 inputs an area including the object area in the binarized image to the discriminator to determine whether or not the outer shape of the object area is rectangular based on an output from the discriminator.

When it is determined by the rectangular determined unit 155 that the outer shape of the object area is not rectangular, the multi-feed determination module 156 determines that the multi-feed of the medium has occurred (step S111).

When it is determined that the multi-feed of the medium has occurred, the control module 151 executes an abnormal processing (step S112) and ends the series of steps. The control module 151 stops the motor 131 to stop feeding and conveying the medium by the conveying roller, as the abnormality processing. Further, the control module 151 displays information indicating that the multi-feed of the medium has occurred on the display device 106 or transmits the information to the information processing apparatus via the interface device 132, to notify the user, as the abnormal processing. The control module 151 may stop the medium reading processing after ejecting the currently conveyed medium, as an abnormal process. Further, the control module 151 may drive the motor 131, to control the conveying roller so as to re-feed after returning the medium once to the medium tray 103 by reverse feeding the medium, as an abnormality process. Thus, the user does not need to re-place the medium on the medium tray 103 and re-feed, and thereby, the control module 151 can improve the convenience of the user.

On the other hand, when it is determined that the outer shape of the object area is rectangular by the rectangular determination module 155 in step S110, the multi-feed determination module 156 presumes that the adhered object may be adhered to the conveyed medium, or that a small medium is multi-fed inside the conveyed medium. In this case, the multi-feed determination module 156 determines whether or not an overlap size being a size of an area in which an overlap of the medium has occurred, is equal to or more than a size threshold (step S113). The size threshold is set to, for example, a size of a photograph adhered to a general resume, or a value acquired by adding a margin to a size of the postage stamp or the revenue stamp (e.g., 50 mm).

The multi-feed determination module 156 calculates the size of the area in which the transmission information detected by the overlap detection module 153 is within the predetermined range, as the overlap size. The multi-feed determination module 156 determines that the overlap of the medium has occurred at a position at which the calculated value (the statistical value of the transmission information or the transmission information itself detected within a predetermined period) based on the transmission information is less than the overlap threshold. When all the calculated values are equal to or more than the overlap threshold, the multi-feed determination module 156 sets the overlap size to 0. On the other hand, when any of the calculated values is less than the overlap threshold, the multi-feed determination module 156 calculates a value acquired by multiplying the maximum continuous time in which a state where the calculated value is less than the overlap threshold is continuous, by a conveyance speed of the medium, as the overlap size.

The multi-feed determination module 156 calculates the overlap size in the medium conveying direction A2 for each ultrasonic sensor 116 when the number of the ultrasonic sensors 116 is plural. The multi-feed determination module 156 may calculate the size at which the overlap of the medium has occurred in the width direction A4, in addition to or instead of the size at which the overlap of the medium has occurred in the medium conveying direction A2, as the overlap size. In that case, the multi-feed determination module 156 calculates the overlap size in the width direction A4 based on the location position of the ultrasonic sensor 116 which outputs the transmission information which is less than the first multi-feed threshold.

In general, the size of a label or a small size paper piece, etc., adhered to the medium is sufficiently smaller than the size of the medium itself. On the other hand, an area in which media overlaps when the multi-feed of the medium has occurred due to a frictional force between the media, is likely to be larger than a size of a label or a small size paper piece, etc., adhered to a medium. That is, as shown in FIG. 8A and FIG. 8B, the overlap size S2 of an area in which the medium M3 and the medium M4 overlap is likely to be larger than the overlap size Si of an area in which the adhered object M2, such as a revenue stamp, is adhered in the medium M1. Therefore, the multi-feed determination module 156 can more accurately determine whether the multi-feed of the medium has occurred or the medium to which the adhered object is attached has been conveyed, by setting the size threshold to a value between the size of the area in which the media overlaps when the multi-feed has occurred and the size of the adhered object.

When the overlap size is equal to or larger than the size threshold, the multi-feed determination module 156 determines that the multi-feed has occurred (step S111), and the control module 151 executes the abnormality processing (step S112) and ends the series of steps.

On the other hand, when the overlap size is less than the size threshold, the multi-feed determination module 156 determines whether or not the calculated value (the statistical value of the transmission information or the transmission information itself detected within the predetermined period) based on the transmission information is less than the multi-feed threshold (step S114). The multi-feed threshold is set to a value between the transmission information detected when one medium is conveyed and the transmission information detected when the multi-feed of the medium has occurred, and a value smaller than the overlap threshold. In particular, the multi-feed threshold is set to a value between the transmission information detected when the medium to which the adhered object is adhered is conveyed and the adhered object is positioned at a position facing the ultrasonic sensor 116, and the transmission information detected when the multi-feed of the medium has occurred.

Generally, there is no air layer between the medium and the adhered object when the adhered object is attached to the medium. Thus, the amount of attenuation of the ultrasonic wave is reduced as compared with the case where the adhered object overlaps with the medium without being adhered to the medium. Therefore, as shown in FIGS. 8A and 8B, the transmission information in a portion where the medium M3 and the medium M4 overlap is less than the transmission information in a portion where the adhered object M2 is adhered to the medium M1. The multi-feed determination module 156 can more accurately determine whether or not the multi-feed of the medium has occurred or a medium to which the adhered object is adhered has been conveyed, by setting the multi-feed threshold to a value between the transmission information in the area where the media overlap and the transmission information in the area where the medium is adhered.

When any of the calculated values is less than the multi-feed threshold, the multi-feed determination module 156 determines that the multi-feed has occurred (step S111), and the control module 151 executes the abnormality processing (step S112) and ends the series of steps.

On the other hand, when all the calculated values are equal to or more than the multi-feed threshold, the multi-feed determination module 156 determines that the multi-feed has not occurred (step S115).

In this way, the multi-feed determination module 156 determines whether or not the multi-feed of the medium has occurred based on whether or not the overlap of the medium has been detected and whether or not the outer shape of the object area detected from the input image is rectangular. In particular, the multi-feed determination module 156 determines that the multi-feeding of the media has occurred when the overlap of the media is detected and it is determined that the outer shape of the object area is not rectangular. Thus, the multi-feed determination module 156 can reliably determine that the multi-feed of the medium has occurred when the medium fed next on the rear end side of the medium fed currently is conveyed in an overlapped manner. On the other hand, the multi-feed determination module 156 can suppress erroneous determining that the multi-feed of the medium has occurred when the medium to which the adhered object is adhered has been conveyed.

Further, the multi-feed determination module 156 determines whether or not the multi-feeding of the media has occurred further based on the overlap size when the overlap of the media is detected and it is determined that the outer shape of the object area is rectangular. Thus, the multi-feed determination module 156 can more accurately determine whether or not the medium to which the adhered object is adhered has been conveyed, and can suppress erroneously determining that the multi-feed of the medium has occurred when the medium to which the adhered object is adhered has been conveyed.

Further, the multi-feed determination module 156 determines whether or not the multi-feed of the media has occurred further based on the magnitude of the transmission information when the overlap of the medium is detected and it is determined that the outer shape of the object area is rectangular. Thus, the multi-feed determination module 156 can more accurately determine whether the medium to which the adhered object is attached is conveyed, and when the medium to which the adhered object is attached is conveyed, erroneously determining that the multi-feed of the medium has occurred can be suppressed.

Further, when the state in which the calculated value is less than the multi-feed threshold is equal to or less than a predetermined time, the multi-feed judgment module 156 may determine that the state occurs by an external noise or a bubble in the adhered object, and may exclude the area corresponding to the state from a target area in which the multi-feed is determined. Thus, the multi-feed determination module 156 can reduce the influence of noise in the multi-feed determination.

Next, the control module 151 determines whether or not a medium remains on the medium tray 103 based on a first medium signal acquired from the first medium sensor 111 (step S116). When a medium remains on the medium tray 103, the control module 151 returns the process to step S104 and repeats the processes in steps S104 to S116.

On the other hand, when no medium remains on the medium tray 103, the control module 151 stops the motor 131 to stop the pick roller 112, the feed roller 113, the brake roller 114, and the first to eighth conveyance rollers 117*a* to 117*h* (step S117), and ends the series of steps.

The process of step S113 and/or step S114 may be omitted. That is, the multi-feed determining unit 156 may determine that the adhered object is adhered to the medium and determine that the multi-feed of the medium has not occurred when the overlap of the medium is detected and it is determined that the outer shape of the object area is rectangular.

The transmission information may indicate the magnitude of a shift of a phase of the ultrasonic wave received by the ultrasonic receiver 116*b* with respect to a phase of the ultrasonic wave transmitted by the ultrasonic transmitter 116*a*, instead of the magnitude of the ultrasonic wave received by the ultrasonic receiver 116*b*. The shift of the phase of the ultrasonic wave passing through the media when the media overlaps, is larger than the shift of the phase when a medium does not overlap. Therefore, the medium conveying apparatus 100 can determine whether or not the multi-feed of the medium has occurred based on the magnitude of the shift of the phase of the ultrasonic wave.

As described in detail above, the medium conveying apparatus 100 determines whether or not the multi-feed of the medium has occurred based on whether or not the overlap of the medium has been detected and whether or not the outer shape of the object area in the input image is rectangular. When the medium to which the adhered object is adhered has been conveyed, the outer shape of the object area is rectangular. On the other hand, when a plurality of media are multi-fed, the positions of the plurality of media is likely to deviate from each other, the outer shape of the object area is likely to be non-rectangular. Therefore, the medium conveying apparatus 100 can determine whether or not the multi-feed of the medium has occurred with higher accuracy.

In particular, the medium conveying apparatus 100 can detect the multi-feed of a small size medium having substantially the same size as a size of the adhered object, with high accuracy, by determining whether or not the outer shape of the object area is rectangular. Further, the medium conveying apparatus 100 can detect the multi-feed of the medium whose amount of attenuation of the ultrasonic wave is substantially the same as the amount of attenuation of the medium to which the adhered object is adhered, with high accuracy, by determining whether or not the outer shape of the object area is rectangular. Further, the medium conveying apparatus 100 can determine whether or not the multi-feed of the medium has occurred with high accuracy even when the medium to which adhered object is adhered and the media of various sizes are mixed and conveyed.

The medium conveying apparatus 100 can suppress erroneously determining that the multi-feed has occurred, and stopping the conveyance of the medium when the medium to which the adhered object is adhered has been conveyed. Thus, the medium conveying apparatus 100 can suppress an increase in the total time required for the medium reading processing. Further, the user does not need to re-place the medium on the medium tray 103 and cause the medium conveying apparatus 100 to re-convey it. Therefore, the medium conveying apparatus 100 can improve the convenience of the user.

Further, the medium conveying apparatus 100 determines whether or not the multi-feed of the medium has occurred by determining whether or not the entire outer shape of the object area is rectangular, rather than determining whether or not the multi-feed of the medium has occurred using a state of each side of the object area in the input image. Thus, the medium conveying apparatus 100 can determine whether or not the multi-feed of the medium has occurred with higher accuracy. In general, the medium conveying apparatus 100 detects the outer shape of the medium when cropping an area where the medium is imaged in the input image. Therefore, the medium conveying apparatus 100 can efficiently and simply determine whether or not the multi-feed of the medium has been occurred, utilizing the existing processing.

Figure 10:
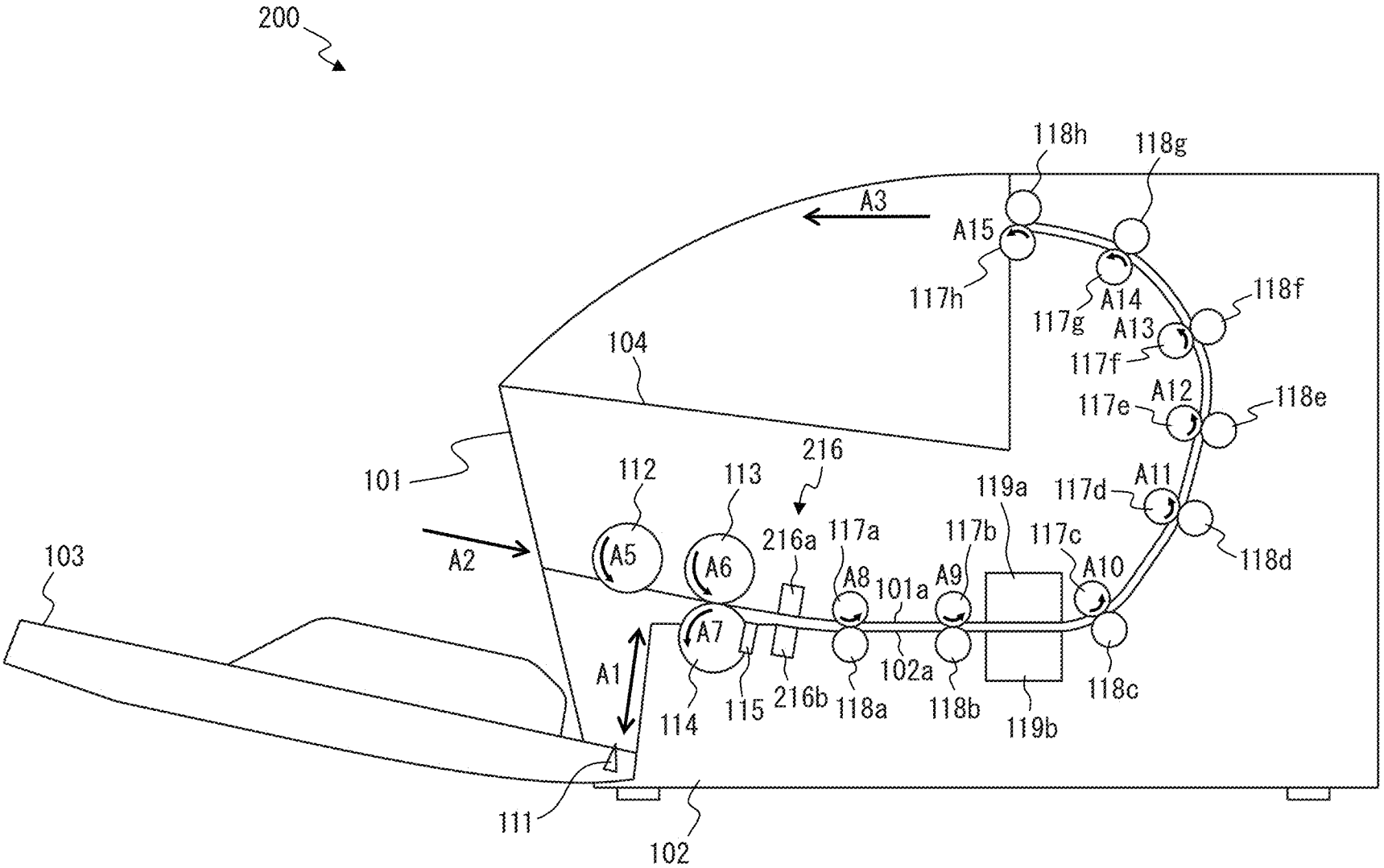
FIG. 10 is a diagram for illustrating a conveyance path inside a medium conveying apparatus 200 according to another embodiment.

FIG. 10 is a diagram for illustrating a conveyance path inside the medium conveying apparatus 200 according to another embodiment.

As shown in FIG. 10, the medium conveying apparatus 200 includes the respective portions of the medium conveying apparatus 100. However, the medium conveying apparatus 200 includes a thickness sensor 216 instead of the ultrasonic sensor 116.

The thickness sensor 216 is located on the downstream side of the feed roller 113 and the brake roller 114 and on the upstream side of the first to eighth conveyance rollers 117*a* to 117*h* and the first to eighth driven rollers 118*a* to 118*h*. The thickness sensor 216 includes a light emitter 216*a* and a light receiver 216*b*. The light emitter 216*a* and the light receiver 216*b* are located close to the conveyance path of the medium in such a way as to face one another with the conveyance path in between. The light emitter 216*a* emits light (infrared light or visible light) toward the light receiver 216*b*. On the other hand, the light receiver 216*b* receives the light emitted by the light emitter 216*a*, and generates and outputs a thickness signal being an electric signal corresponding to the intensity of the received light. When a medium exists at the position of the thickness sensor 216, the light emitted by the light emitter 216*a* is attenuated by the medium, and the greater the thickness of the medium, the greater the amount of attenuation. For example, the thickness sensor 216 generates the thickness signal such that the greater the thickness of the medium, the greater the signal value. The thickness signal indicates the thickness information of the medium at a plurality of positions in the conveyed medium by the conveying roller. The number of the thickness sensor 216 is not limited to one, and may be plural. In that case, a plurality of thickness sensors 216 are spaced and located along in the width direction A4.

A reflected light sensor, a pressure sensor or a mechanical sensor may be used as the thickness sensor 216. The reflected light sensor includes a pair of light emitter and light receiver provided on one side with respect to a conveyance path of the medium and a pair of light emitter and light receiver provided on the other side. The reflected light sensor detects a distance between each pair and each surface of the medium, based on a time from when one pair emits light to one surface of the medium to when it receives the reflected light and a time from when the other pair emits light to the other surface of the medium to when it receives the reflected light. The reflected light sensor generates a thickness signal which indicates a subtracted value acquired by subtracting each detected distance from a distance between the two pairs, as the thickness information. The pressure sensor detects a pressure which changes according to the thickness of the medium, and generates a thickness signal which indicates the detected pressure, as the thickness information. The mechanical sensor detects a movement amount of a contact member such as a roller in contact with the medium, and generates a thickness signal which indicates the detected movement amount, as the thickness information.

The medium conveying apparatus 200, similarly to the medium conveying apparatus 100, executes the medium read processing illustrated in FIGS. 5 and 6.

However, in step S105 of FIG. 5, the overlap detection module 153 receives the thickness signal from the thickness sensor 216. The overlap detection module 153 detects the thickness information indicated in the received thickness signal as the thickness information of the medium conveyed by the conveying roller, and stores it in the storage device 140 in association with the current time.

Further, in step S108 of FIG. 6, the overlap detection module 153 determines whether or not the overlap of the medium conveyed by the conveying roller has occurred, based on the thickness information stored in the storage device 140. The overlap detection module 153 determines whether or not the overlap of the medium has occurred by comparing the calculated value based on the thickness information stored in the storage device 140 and the overlap threshold. The overlap threshold is set to a value between the thickness information detected when one medium is conveyed and the thickness information detected when the multi-feed of the medium has occurred. The overlap detection module 153 calculates a statistical value (an average value, a median value, a maximum value or a minimum value) of the thickness information detected within a predetermined period before and after each thickness information is detected, as the calculated value. The multi-feed determination module 156 may use each thickness information itself as the calculation value. The overlap detection module 153 determines that the overlap of the media has occurred when any of the calculated values is larger than the overlap threshold, and the overlap detection module 153 determines that the overlap of the media has not occurred when all the calculated values are equal to or less than the overlap threshold.

Figure 11A:
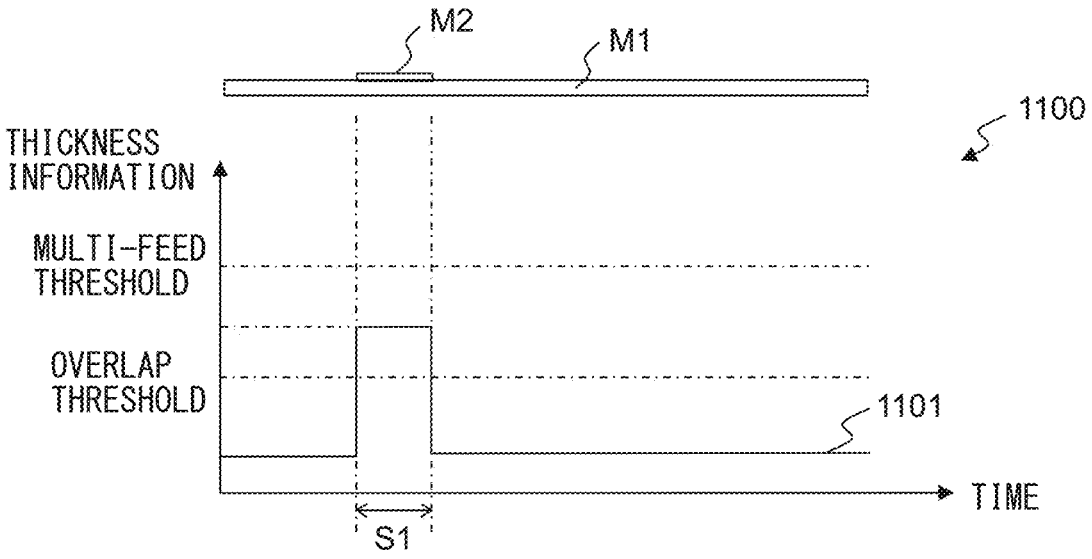
FIG. 11A is a graph showing characteristics of thickness information.
Figure 11B:
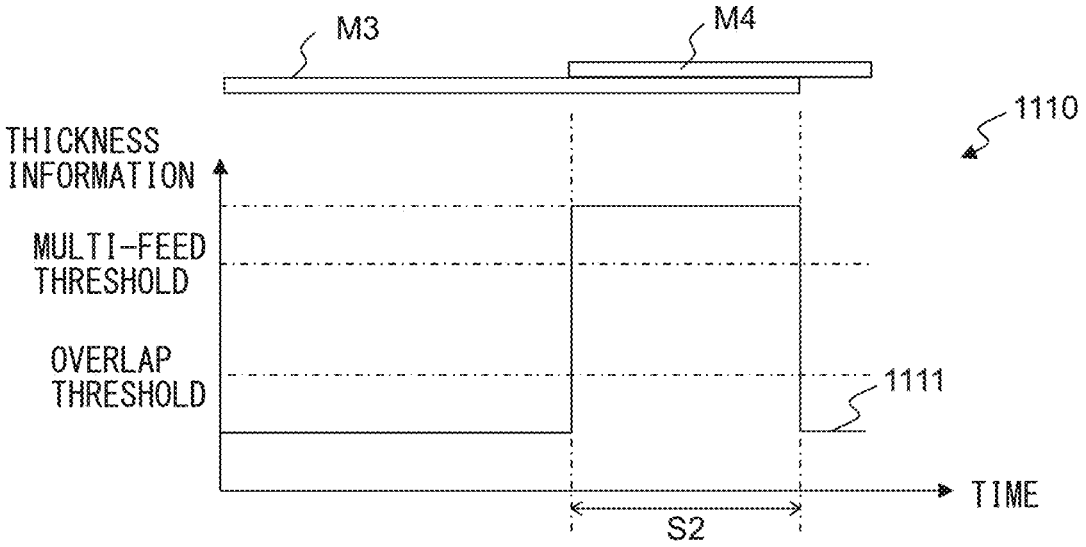
FIG. 11B is a graph showing the characteristics of the thickness information.

FIGS. 11A and 11B are graphs 1100 and graphs 1110 illustrating characteristics of the thickness information (the thickness of the medium).

The horizontal axes of the graph 1100 and the graph 1110 indicate time, the vertical axes indicate the value of the thickness information. In the graph 1100, the solid line 1101 indicates the characteristics of the thickness information when the medium M1 and the adhered object M2 shown in FIG. 7A are conveyed. In the area where the adhered object M2 is adhered in the medium M1, the value of the thickness information is increased and is larger than the overlap threshold. On the other hand, in the graph 1110, the solid line 1111 indicates the characteristics of the thickness information when the medium M3 and the medium M4 shown in FIG. 7B are conveyed. In the area where the medium M3 and the medium M4 overlap, the value of the thickness information is increased and is larger than the overlap threshold. Therefore, the overlap detection module 153 detects the overlap of the medium based on the thickness information of the medium when the medium to which the adhered object is adhered is conveyed, or when a plurality of media are conveyed in an overlapped manner.

Further, in step S113, the multi-feed determination module 156 calculates the size of the area in which the thickness information detected by the overlap detection module 153 is within the predetermined range, as the overlap size. The multi-feed determination module 156 determines that the overlap of the medium has occurred at a position at which the calculated value based on the thickness information (the statistical value of the thickness information or the thickness information itself detected within a predetermined period) is larger than the overlap threshold. The multi-feed determination module 156 sets the overlap size to 0 when all the calculated values are equal to or less than the overlap threshold. On the other hand, when any of the calculated values is larger than the overlap threshold, the multi-feed determination module 156 calculates a value acquired by multiplying the maximum continuous time in which a state where the calculated value is larger than the overlap threshold is continuous, by a conveyance speed of the medium, as the overlap size.

The multi-feed determination module 156 calculates the overlap size in the medium conveying direction A2 for each thickness sensors 216 when the number of the thickness sensors 216 is plural. The multi-feed determination module 156 may calculate the size at which the overlap of the medium has occurred in the width direction A4, in addition to or instead of the size at which the overlap of the medium has occurred in the medium conveying direction A2, as the overlap size. In this case, the multi-feed determination module 156 calculates the overlap size in the width direction A4 based on the location position of the thickness sensor 216 which outputs the thickness information which is larger than the overlap threshold.

Further, in step S114, the multi-feed determination module 156 determines whether or not the calculated value based on the thickness information (the statistical value of the thickness information or the thickness information itself detected within a predetermined period) is larger than the multi-feed threshold. The multi-feed threshold is a value between the thickness information detected when one medium is conveyed and the thickness information detected when the multi-feed of the medium has occurred, and a value larger than the overlap threshold. In particular, the multi-feed threshold is set to a value between the thickness information detected when the medium to which the adhered object is adhered is conveyed and the adhered object is positioned at a position facing the thickness sensor 216 and the thickness information detected when the multi-feed of the medium has been occurred.

When an adhered object is adhered to a medium, the medium and the adhered object are in contact with each other closely. Therefore, the thickness of the medium and the adhered object may be small, compared with the medium and the adhered object in the case where the adhered object overlaps with the medium without being adhered to the medium. Therefore, as shown in FIGS. 11A and 11B, the thickness information in a portion where the medium M3 and the medium M4 overlap is more than the thickness information in a portion where the adhered object M2 is adhered to the medium M1. The multi-feed determination module 156 can more accurately determine whether or not the multi-feed of the medium has occurred or a medium to which the adhered object is adhered has been conveyed, by setting the multi-feed threshold to a value between the thickness information in the area where the media overlap and the thickness information in the area where the medium is adhered.

The multi-feed determination module 156 determines that the multi-feed has occurred when any of the calculated values is larger than the multi-feed threshold, and the multi-feed determination module 156 determines that the multi-feed has not occurred when all the calculated values are equal to or less than the multi-feed threshold.

In this way, the multi-feed determination module 156 determines whether or not the multi-feed of the media has occurred further based on the magnitude of the thickness information when the overlap of the medium is detected and it is determined that the outer shape of the object area is rectangular. Thus, the multi-feed determination module 156 can more accurately determine whether or not the medium to which the adhered object is adhered has been conveyed, and can suppress erroneously determining that the multi-feed of the medium has occurred when the medium to which the adhered object is adhered has been conveyed.

As described in detail above, the medium conveying apparatus 200 can determine whether or not the multi-feed of the medium has occurred, with high accuracy, even when determining whether or not the multi-feed of the medium has occurred based on the thickness information of the medium.

Figure 12:
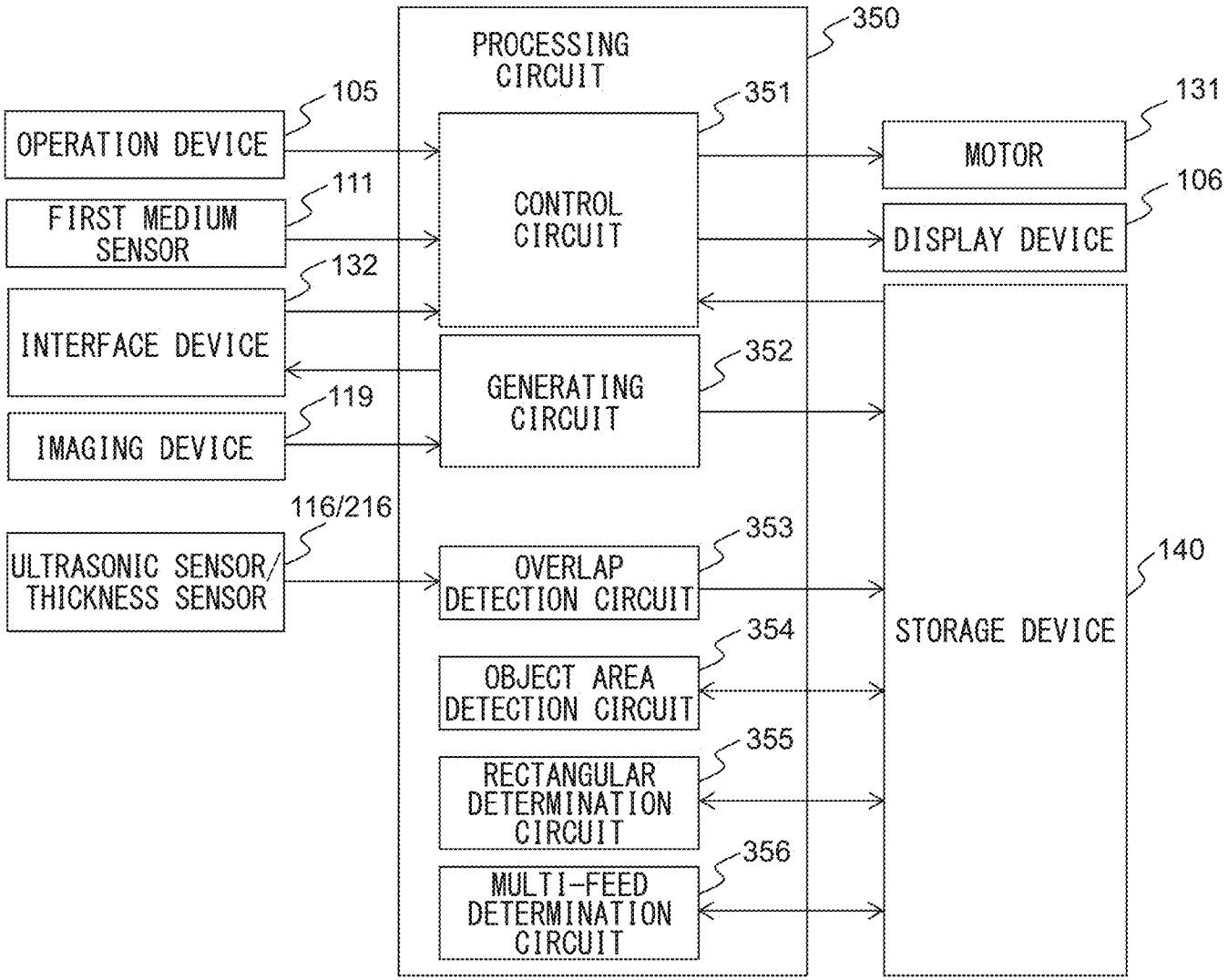
FIG. 12 is a diagram illustrating a schematic configuration of a processing circuit 350 in a medium conveying apparatus according to another embodiment.

FIG. 12 is a diagram illustrating a schematic configuration of a processing circuit 350 of a medium conveying apparatus according to another embodiment.

The processing circuit 350 is used in place of the processing circuit 150 and executes the medium read processing, etc., instead of the processing circuit 150. The processing circuit 350 includes a control circuit 351, a generating circuit 352, an overlap detection circuit 353, an object area detection circuit 354, a rectangular determination circuit 355 and a multi-feed determination circuit 356. Note that each unit may be configured by an independent integrated circuit, a microprocessor, firmware, etc.

The control circuit 351 is an example of a control module, and has a function similar to the control module 151. The control circuit 351 receives an operation signal from the operation device 105 or the interface device 132, receives the first medium signal from the first medium sensor 111, and controls the motor 131 to convey the medium based on each received signal. Further, the control circuit 351 reads the determination result of whether or not the multi-feed has occurred from the storage device 140, and executes the abnormality processing when it is determined that the multi-feed of the medium has occurred.

The generating circuit 352 is an example of a generating module, and has a function similar to the generating module 152. The generation circuit 352 acquires line images from the imaging device 119 to generate an input image, stores it in the storage device 140, and outputs to the interface device 132.

The overlap detection circuit 353 is an example of an overlap detection module, and has a function similar to the overlap detection module 153. The overlap detection circuit 353 receives the ultrasonic signal from the ultrasonic sensor 116 or the thickness signal from the thickness sensor 216, detects the overlap of the medium based on the received signal, and stores the detection result in the storage device 140.

The object area detection circuit 354 is an example of the object area detection module, and has a function similar to the object area detection module 154. The object area detection circuit 354 reads the input image from the storage device 140, detects the object area from the read input image, and stores the detection result in the storage device 140.

The rectangular determination circuit 355 is an example of a rectangular determination module, and has a function similar to the rectangular determination module 155. The rectangular determination circuit 355 reads out the detection result of the object area from the storage device 140, determines whether or not the outer shape of the object area is rectangular, and stores the determination result in the storage device 140.

The multi-feed determination circuit 356 is an example of the multi-feed determination module, and has a function similar to the multi-feed determination module 156. The multi-feed determination circuit 356 reads the detection result of the overlap of the medium and the determination result of whether or not the outer shape of the object area is rectangular from the storage device 140, determines whether or not the multi-feed of the medium has occurred based on the read information, and stores the determination result in the storage device 140.

As described in detail above, the medium conveying apparatus can determine whether or not the multi-feed of the medium has occurred, with higher accuracy, even when the medium reading processing is performed by the processing circuit 350.

According to the embodiment, the medium conveying apparatus, the method, and the computer-readable, non-transitory medium storing the control program, can determine whether or not the multi-feed of the medium has occurred with higher accuracy.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a conveying roller to convey a rectangular medium; and a processor to generate an input image acquired by imaging the conveyed medium, determine whether an overlap of the conveyed medium has occurred, determine whether an outer shape of an object area included in the input image is rectangular, determine whether a multi-feed of the medium has occurred based on whether it is determined that the overlap of the medium has occurred and whether the outer shape of the object area is rectangular, and execute an abnormality processing when it is determined that the multi-feed of the medium has occurred.

2. The medium conveying apparatus according to claim 1, wherein the processor determines that the multi-feed of the medium has occurred when it is determined that the overlap of the medium has occurred and it is determined that the outer shape of the object area is not rectangular.

3. The medium conveying apparatus according to claim 1, wherein the processor determines whether the overlap of the conveyed medium has occurred based on an ultrasonic wave transmitted through the conveyed medium or thickness information of the medium, and determines whether the multi-feed of the medium has occurred further based on a magnitude of the ultrasonic wave or the thickness information, or a size of an area in which the overlap of the medium has occurred when it is determined that the overlap of the medium has occurred and it is determined that the outer shape of the object area is rectangular.

4. The medium conveying apparatus according to claim 1, wherein the processor determines whether the outer shape of the object area is rectangular based on an angle formed by a plurality of straight lines included in the input image, a number of the plurality of straight lines, or a length of the plurality of straight lines.

5. A method for determining a multi-feed of a medium, comprising:

conveying a rectangular medium, by a conveying roller;

generating an input image acquired by imaging the conveyed medium;

detecting an overlap of the conveyed medium;

detecting an object area from the input image;

determining whether an outer shape of the object area is rectangular;

determining whether a multi-feed of the medium has occurred based on whether the overlap of the medium has been detected and whether the outer shape of the object area is rectangular; and executing an abnormality processing when it is determined that the multi-feed of the medium has occurred.

6. The method according to claim 5, wherein it is determined that the multi-feed of the medium has occurred when the overlap of the medium is detected and it is determined that the outer shape of the object area is not rectangular.

7. The method according to claim 5, wherein the overlap of the conveyed medium is detected based on transmission information of an ultrasonic wave transmitted through the conveyed medium or thickness information of the medium, and wherein whether the multi-feed of the medium has occurred is determined further based on a magnitude of the transmission information or the thickness information, or a size of an area in which the overlap of the medium has occurred when the overlap of the medium is detected and it is determined that the outer shape of the object area is rectangular.

8. The method according to claim 5, wherein whether the outer shape of the object area is rectangular is determined based on an angle formed by a plurality of straight lines included in the input image, a number of the plurality of straight lines, or a length of the plurality of straight lines.

9. A computer-readable, non-transitory medium storing a computer program, wherein the computer program causes a medium conveying apparatus including a conveying roller to convey a rectangular medium, to execute a process, the process comprising:

generating an input image acquired by imaging the conveyed medium;

detecting an overlap of the conveyed medium;

detecting an object area from the input image;

determining whether an outer shape of the object area is rectangular;

determining whether a multi-feed of the medium has occurred based on whether the overlap of the medium has been detected and whether the outer shape of the object area is rectangular; and executing an abnormality processing when it is determined that the multi-feed of the medium has occurred.

10. The computer-readable, non-transitory medium according to claim 9, wherein it is determined that the multi-feed of the medium has occurred when the overlap of the medium is detected and it is determined that the outer shape of the object area is not rectangular.

11. The computer-readable, non-transitory medium according to claim 9, wherein the overlap of the conveyed medium is detected based on transmission information of an ultrasonic wave transmitted through the conveyed medium or thickness information of the medium, and wherein whether the multi-feed of the medium has occurred is determined further based on a magnitude of the transmission information or the thickness information, or a size of an area in which the overlap of the medium has occurred when the overlap of the medium is detected and it is determined that the outer shape of the object area is rectangular.

12. The computer-readable, non-transitory medium according to claim 9, wherein whether the outer shape of the object area is rectangular is determined based on an angle formed by a plurality of straight lines included in the input image, a number of the plurality of straight lines, or a length of the plurality of straight lines.

* * * * *